US012291417B2

(12) United States Patent
Okada et al.

(10) Patent No.: US 12,291,417 B2
(45) Date of Patent: May 6, 2025

(54) SHEET POSTPROCESSING DEVICE THAT PERFORMS POSTPROCESSING ON PLURALITY OF SHEETS STACKED, AND IMAGE FORMING SYSTEM INCLUDING SAME

(71) Applicant: KYOCERA Document Solutions Inc., Osaka (JP)

(72) Inventors: Takehiko Okada, Osaka (JP); Yusuke Takano, Osaka (JP); Keisuke Egawa, Osaka (JP); Yasunori Ueno, Osaka (JP); Seiichi Shirasaki, Osaka (JP); Terumitsu Noso, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/418,662

(22) Filed: Jan. 22, 2024

(65) Prior Publication Data

US 2024/0253939 A1 Aug. 1, 2024

(30) Foreign Application Priority Data

Jan. 30, 2023 (JP) ..... 2023-012221

(51) Int. Cl.
*B65H 31/26* (2006.01)
*B65H 31/02* (2006.01)
(Continued)

(52) U.S. Cl.
CPC ..... *B65H 37/04* (2013.01); *B65H 31/02* (2013.01); *B65H 31/34* (2013.01); *B65H 45/00* (2013.01); *B65H 2404/7412* (2013.01)

(58) Field of Classification Search
CPC ..... B65H 37/04; B65H 45/12; B65H 45/18; B65H 31/02; B65H 31/26; B65H 31/34;
(Continued)

(56) References Cited

U.S. PATENT DOCUMENTS 7,419,150 B2 * 9/2008 Kushida ..... B65H 31/26 270/58.11
7,837,186 B2 * 11/2010 Taki ..... B65H 31/36 399/407

(Continued)

FOREIGN PATENT DOCUMENTS

JP 2007145570 A 6/2007
JP 2019206418 A 12/2019

*Primary Examiner* — Leslie A Nicholson, III
(74) *Attorney, Agent, or Firm* — IP Business Solutions, LLC.

(57) ABSTRACT

A sheet postprocessing device includes a saddle binding device configured to stack a plurality of recording sheets on a table, abut leading edges of the respective recording sheets against a leading edge cursor, thus to align the leading edges with each other, and bind the center of the recording sheets and fold the recording sheets, and a first pressing member supported so as to pivot in a direction toward and away from the table. The first pressing member is made to pivot toward the table by self-weight thereof, allows the leading edge of the recording sheet delivered to the table to pass toward the leading edge cursor, and presses a portion of the recording sheet in a proximity of the leading edge, at a position upstream of the leading edge cursor, in a delivery direction of the recording sheet.

6 Claims, 15 Drawing Sheets

(51) Int. Cl.
*B65H 31/34* (2006.01)
*B65H 37/04* (2006.01)
*B65H 45/00* (2006.01)

(58) Field of Classification Search
CPC ..... B65H 2404/741; B65H 2404/7414; B65H 2404/7412; B65H 2301/4222; B65H 2301/4223
USPC ..... 270/37, 58.08, 58.12, 58.17
See application file for complete search history.

(56) References Cited

U.S. PATENT DOCUMENTS

| | | | | |
|---|---|---|---|---|
| 8,028,979 | B2 * | 10/2011 | Taguchi | B41L 43/02 270/32 |
| 10,221,031 | B2 * | 3/2019 | Endo | B65H 31/02 |
| 11,077,694 | B2 * | 8/2021 | Noso | G03G 15/6544 |
| 11,111,096 | B2 * | 9/2021 | Fujishima | B65H 31/36 |
| 2007/0120308 | A1 | 5/2007 | Takemoto et al. | |
| 2019/0367312 | A1 | 12/2019 | Kishimoto et al. | |

* cited by examiner

SHEET POSTPROCESSING DEVICE THAT PERFORMS POSTPROCESSING ON PLURALITY OF SHEETS STACKED, AND IMAGE FORMING SYSTEM INCLUDING SAME

INCORPORATION BY REFERENCE

This application claims priority to Japanese Patent Application No. 2023-012221 filed on Jan. 30, 2023, the entire contents of which are incorporated by reference herein.

BACKGROUND

The present disclosure relates to a sheet postprocessing device that performs postprocessing on a plurality of sheets stacked on each other, and an image forming system including the same. In particular, the present disclosure relates to a technique to align the edges of the stacked sheets.

In many of existing image forming apparatuses, an image reading device reads the image of a source document, and an image forming device forms the image of the source document on a recording sheet. In addition, sheet postprocessing devices are known that receive the recording sheet, having the image of the source document formed thereon, from the image forming apparatus, and perform postprocessing on the recording sheet. The postprocessing performed by the postprocessing device includes, for example, a saddle binding operation including stacking a plurality of recording sheets on a table, aligning the edges of the recording sheets on the table, binding the center of the recording sheets, and folding the recording sheets. To perform the saddle binding operation, it is necessary to properly align the recording sheets on the table.

For example, some sheet loading mechanisms are configured to move a sheaf lifting cursor on a sheet receiving tray to a prespecified position, spaced from a delivery port of the sheet by a distance corresponding to the length of the sheet, so that the leading edge of the sheet delivered to the sheet receiving tray through the delivery port is abutted against the sheaf lifting cursor. Then the sheaf lifting cursor is moved such that the trailing edge of the sheet abutted against the sheaf lifting cursor is located on the lower side of the delivery port, where the trailing edge of the sheet is kept from contacting the leading edge of the sheet delivered next, and then the sheaf lifting cursor is returned to the initial prespecified position. Such a sheet loading mechanism surely maintains the correct order of the sheets accumulated on the sheet receiving tray, and prevents occurrence of transport jam arising from collision of the sheets.

In addition, some sheet postprocessing devices are configured to blow air, when the sheets are delivered to a sheet tray to be stacked thereon, from a transport route through a delivery guide, into between the upper face of the uppermost one of the sheets stacked on the sheet tray, and the lower face of the next sheet being delivered to the sheet tray through the delivery guide. The sheet postprocessing device thus configured prevents the next sheet being delivered to the sheet tray from making a close contact with the uppermost sheet on the sheet tray, thereby also preventing occurrence of paper jam.

SUMMARY

The disclosure proposes further improvement of the foregoing techniques.

In an aspect, the disclosure provides a sheet postprocessing device including a table, a delivery roller, a leading edge cursor, a stapling device, a center folding device, and a first pressing member. The table receives a sheet. The delivery roller delivers the sheet to the table. The is provided on the table, so that a leading edge of the sheet in a delivery direction in which the sheet is delivered, is abutted against the leading edge cursor. The stapling device binds a central position in the delivery direction, of a plurality of the sheets stacked on the table. The center folding device folds the sheets, the central position of which has been bound by the stapling device, at the central position. The first pressing member is located on an upper side of the table, and supported so as to pivot in a direction toward and away from the table, about an end portion on an upstream side in the delivery direction serving as a pivotal fulcrum. The first pressing member makes contact with the sheet being delivered to the table, by pivoting toward the table, allows the leading edge of the sheet to pass toward the leading edge cursor, and holds the sheet at a position upstream of the leading edge cursor in the sheet delivery direction.

In another aspect, the disclosure provides an image forming system including an image forming apparatus that forms an image of a source document on a sheet, and the foregoing sheet postprocessing device that receives the sheet from the image forming apparatus, and performs postprocessing.

DETAILED DESCRIPTION

Figure 1:
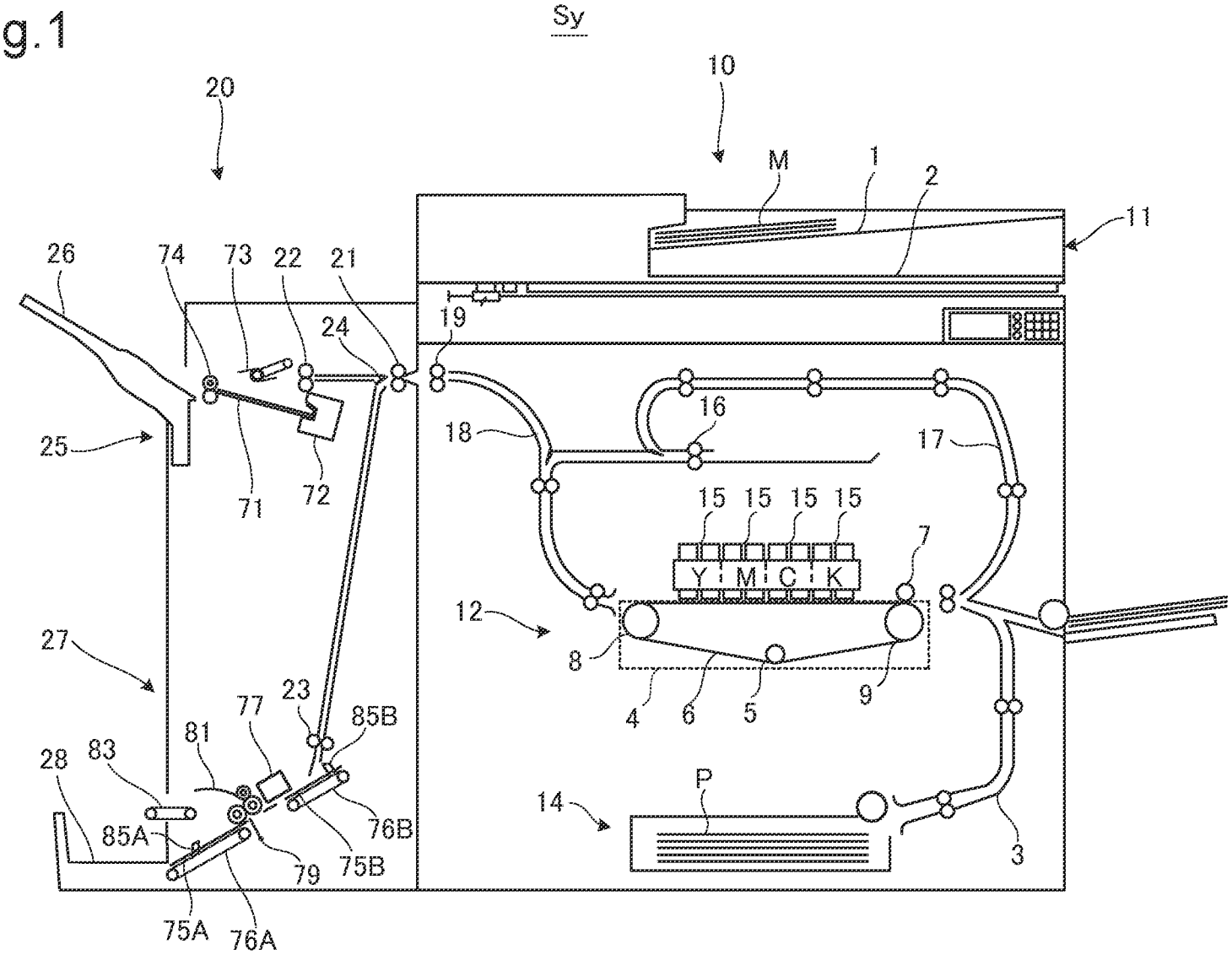
FIG. 1 is a cross-sectional view showing an image forming apparatus and a sheet postprocessing device, constituting an image forming system according to an embodiment of the disclosure.

Hereafter, a sheet postprocessing device according to an embodiment of the disclosure, and an image forming system including the same will be described, with reference to the drawings. FIG. 1 is a cross-sectional view showing an image forming apparatus and the sheet postprocessing device, constituting the image forming system according to the embodiment of the disclosure. The image forming system Sy according to the embodiment includes the image forming apparatus 10 that reads an image of a source document and forms the image on a recording sheet P (corresponding to the sheet in the disclosure), and the sheet postprocessing device 20 that receives the recording sheet from the image forming apparatus 10, and performs postprocessing on the recording sheet.

The image forming apparatus 10 includes an image reading device 11 and an image forming device 12. When a plurality of source documents M are placed on a document tray 1, the image reading device 11 sequentially draws out the source documents M from the document tray 1 one by one, reads the image of each of the source documents M with an image sensor, and sequentially delivers the source documents M to a discharge tray 2, so as to stack the source documents M on each other. The image reading device 11 converts the analog output from the image sensor is converted to a digital signal, with respect to each of the images of the source documents M, and image data representing the image of each of the source documents M is generated.

The image forming device 12 forms the image of the source document M represented by the image data, on the recording sheet P (an example of sheet) through an ink jet process, each time the image data representing the image of each of the source documents M is inputted. The image forming device 12 includes line heads 15 that respectively eject ink of four colors, namely black, cyan, magenta, and yellow. The line heads 15 each eject the ink droplets of the corresponding color onto the recording sheet P, delivered to a conveying unit 4 from a sheet feeding device 14 through a first transport route 3, thereby forming a color image on the recording sheet P.

The conveying unit 4 includes a drive roller 8, a follower roller 9, a tension roller 5, and a transport belt 6. The transport belt 6 is an endless belt stretched around the drive roller 8, the follower roller 9, and the tension roller 5. The drive roller 8 is driven by a non-illustrated motor so as to rotate counterclockwise. When the drive roller 8 is made to rotate, the transport belt 6 revolves counterclockwise, and the follower roller 9 and the tension roller 5 are each passively made to rotate counterclockwise, by the transport belt 6.

The tension roller 5 serves to maintain the tension of the transport belt 6 at an appropriate level. The transport belt 6 is in contact with an adsorption roller 7. The adsorption roller 7 electrically charges the transport belt 6, to thereby electrostatically adsorb the recording sheet P delivered from the sheet feeding device 14, to the transport belt 6.

The images of the source documents M are formed on the respective recording sheets P by the image forming device 12, and the recording sheets P are transported to the sheet postprocessing device 20, through a relay transport route 18 and a transport roller 19.

When the image of the source document M is also to be formed on the back face of the recording sheet P, the image forming apparatus 10 performs switchback transport, including transporting the recording sheet P from the relay transport route 18 to the transport roller 16, temporarily stopping the transport roller 16, and then reversely rotating the same. Then the recording sheet P is returned to the conveying unit 4 through a second transport route 17, with the front and back faces reversed. When the image forming device 12 forms the image of the source document M on the back face of the recording sheet P, the recording sheet P is transported to the sheet postprocessing device 20, through the relay transport route 18 and the transport roller 19.

The sheet postprocessing device 20 includes a plurality of transport rollers 21, 22 and a delivery roller 23 for transporting the recording sheet P delivered from the image forming apparatus 10, a branching nail 24, an edge binding device 25, an output tray 26, a saddle binding device 27, a center folding device 29 (see FIG. 2), and an output tray 28.

The branching nail 24 switches the direction of the recording sheet P that has passed the transport roller 21, between a horizontal route toward the transport roller 22, and a downward route toward the delivery roller 23.

The edge binding device 25 performs stapling operation on an end portion of a plurality of recording sheets P stacked on each other. The output tray 26 receives the recording sheets P, that have undergone the stapling operation by the edge binding device 25. The saddle binding device 27 performs the stapling operation on the central position of a plurality of recording sheets P stacked on each other. The center folding device 29 folds the recording sheets P at the central position, which has been stapled. The output tray 28 receives the recording sheets P, bound by the saddle binding device 27 and folded by the center folding device 29.

The edge binding device 25 includes a processing tray 71 for sequentially receiving the plurality of recording sheets P delivered through the transport rollers 21 and 22, a paddle 73 that biases the recording sheet P so as to move toward the stapling device 72, each time the recording sheet P is delivered to the processing tray 71, a stapling device 72 that performs the stapling operation on an end portion of the plurality of recording sheets P stacked on the processing tray 71, and a delivery roller 74 that delivers the recording sheets P that have undergone the stapling operation by the stapling device 72, to the output tray 26.

Figure 2:
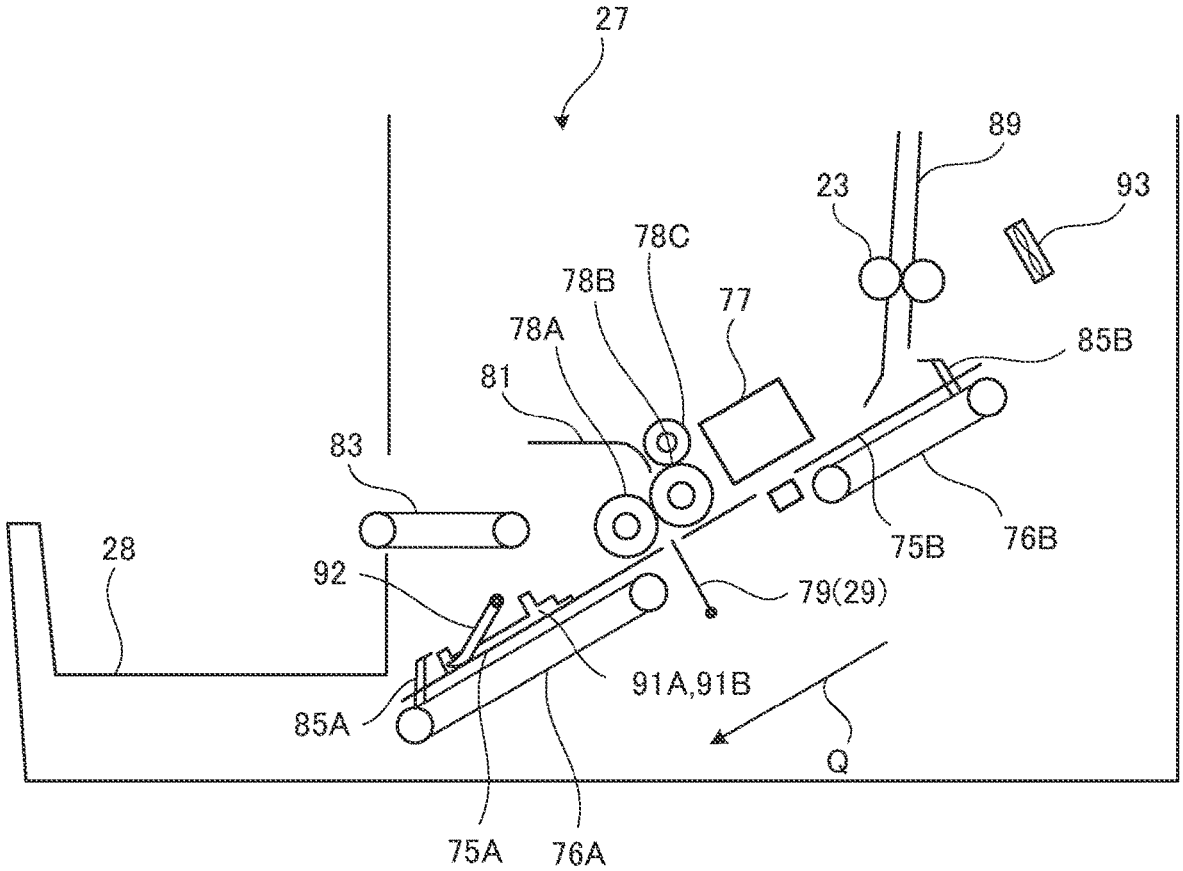
FIG. 2 is an enlarged cross-sectional view showing a saddle binding device in the sheet postprocessing device.

Hereunder, the saddle binding device 27 will be described. FIG. 2 is an enlarged cross-sectional view showing the saddle binding device 27 in the sheet postprocessing device 20.

As shown in FIG. 1 and FIG. 2, the saddle binding device 27 includes divided tables 75A and 75B, a leading edge cursor 85A and a trailing edge cursor 85B, revolving belts 76A and 76B, a stapling device 77, folding rollers 78A, 78B, and 78C, a center folding device 29, a guide 81, a delivery conveyor 83, side-edge cursors 91A and 91B, a first pressing member 92, and a blowing fan 93. The center folding device 29 includes a folding blade 79 and a drive mechanism therefor.

The divided tables 75A and 75B are each configured to receive a plurality of recording sheets P, transported and delivered by the delivery roller 23. The leading edge cursor 85A and the trailing edge cursor 85B move the recording sheets P on the divided tables 75A and 75B, thereby regulating the position of the recording sheets P in the longitudinal direction. The revolving belts 76A and 76B support the respective cursors 85A and 85B, and cause the cursors 85A and 85B to reciprocate along the delivery direction of the recording sheet P. The divided tables 75A and 75B exemplify the table in the disclosure.

The stapling device 77 performs the stapling operation on the central position of the recording sheets P stacked on the divided tables 75A and 75B. The folding rollers 78A, 78B, and 78C are located above the space between the divided tables 75A and 75B, and folds the recording sheets P and transports the same. The folding blade 79 is located so as to oppose the nip region between the folding rollers 78A and 78B, through the space between the divided tables 75A and 75B, and made to reciprocate along a direction toward and away from the nip region.

The guide 81 receives the recording sheets P from the folding rollers 78A and 78B, and guides the recording sheets P. The delivery conveyor 83 transports the recording sheets P toward the output tray 28, and delivers thereto. The side-edge cursors 91A and 91B are provided on the respective sides of the divided table 75A, to regulate the position of the recording sheet P in the width direction. The side-edge cursors 91A and 91B are provided on the divided table 75A at the respective end portions of the leading edge cursor 85A in the width direction, so that the side edges in the width direction, of the respective recording sheets P delivered to the divided table 75A are abutted against the side-edge cursors 91A and 91B, thus to be aligned with each other. The side-edge cursors 91A and 91B are located closer to the side edges of the divided table 75A in the width direction, than is the first pressing member 92. The side-edge cursors 91A and 91B are movable on the divided table 75A in the width direction, among a receiving position for receiving the recording sheet P delivered to the divided table 75A, an aligning position for aligning the side edges of the recording sheets P with a side-edge plate 112 (see FIG. 10), and a regulating position to be subsequently described.

The first pressing member 92 presses the leading edge (the proximity thereof inclusive, the same hereinafter) of the recording sheets P on the divided table 75A. The blowing fan 93 blows air into the region on the lower side of the recording sheet P being delivered to the divided table 75B.

Hereunder, the folding operation of the recording sheets P, performed by the saddle binding device 27 and the center folding device 29, will be described. FIG. 3A to FIG. 3D each illustrate the folding operations of the recording sheet P, performed by the saddle binding device 27 and the center folding device 29.

Figure 3A:
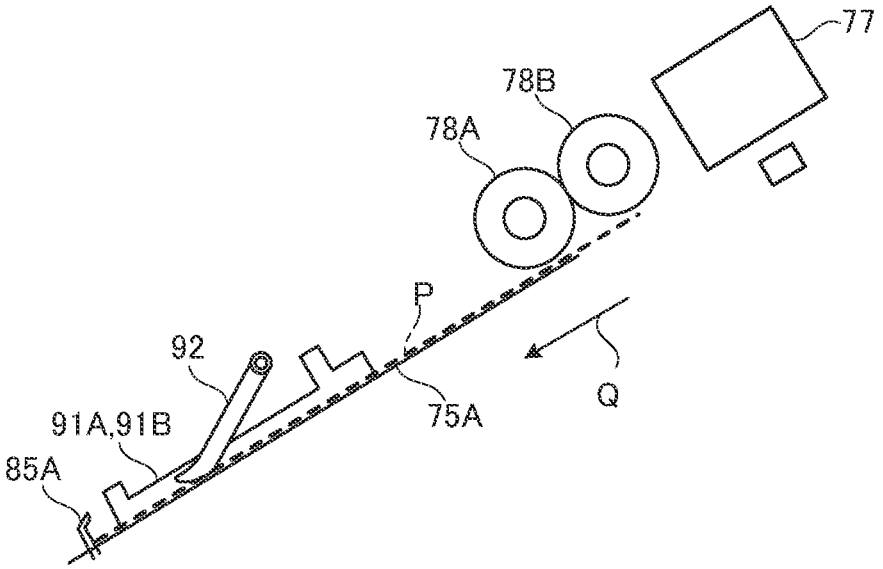
FIG. 3A and FIG. 3B are schematic drawings for explaining an operation of a saddle binding operation, performed by the saddle binding device on a recording sheet.

When the recording sheet P is transported toward the divided tables 75A and 75B and delivered thereto, as shown in FIG. 3A, the leading edge of the recording sheet P is abutted against the leading edge cursor 85A thus to be set in position, and also the respective side edges of the recording sheet P are set in position by the side-edge cursors 91A and 91B, and the first pressing member 92 presses a position on the recording sheet P in the proximity of the leading edge. Then the trailing edge of the recording sheet P is abutted against the trailing edge cursor 85B, either by the movement of the leading edge cursor 85A along the sheet transport direction toward the trailing edge cursor 85B, or by the movement of the trailing edge cursor 85B along the sheet transport direction toward the leading edge cursor 85A. Thereafter, the leading edge cursor 85A or the trailing edge cursor 85B is moved to the initial position. The divided tables 75A and 75B are sloped obliquely downward in the sheet delivery direction, and therefore the recording sheet P is biased obliquely downward by the self-weight, on the divided tables 75A and 75B. Accordingly, the leading edge of the recording sheet P remains abutted against the leading edge cursor 85A. Through the repetition of such actions, a plurality of recording sheets P are stacked on the divided tables 75A and 75B, with the edges aligned. Here, the leading edge cursor 85A, the side-edge cursors 91A and 91B, and the trailing edge cursor 85B may be moved as above, each time a predetermined number of recording sheets P are delivered to the divided tables 75A and 75B, so that the respective leading edges, side edges, and trailing edges of those recording sheets P are aligned by the respective cursors, and that resultantly a plurality of recording sheets P are stacked on the divided tables 75A and 75B, with the edges aligned.

Figure 3B:
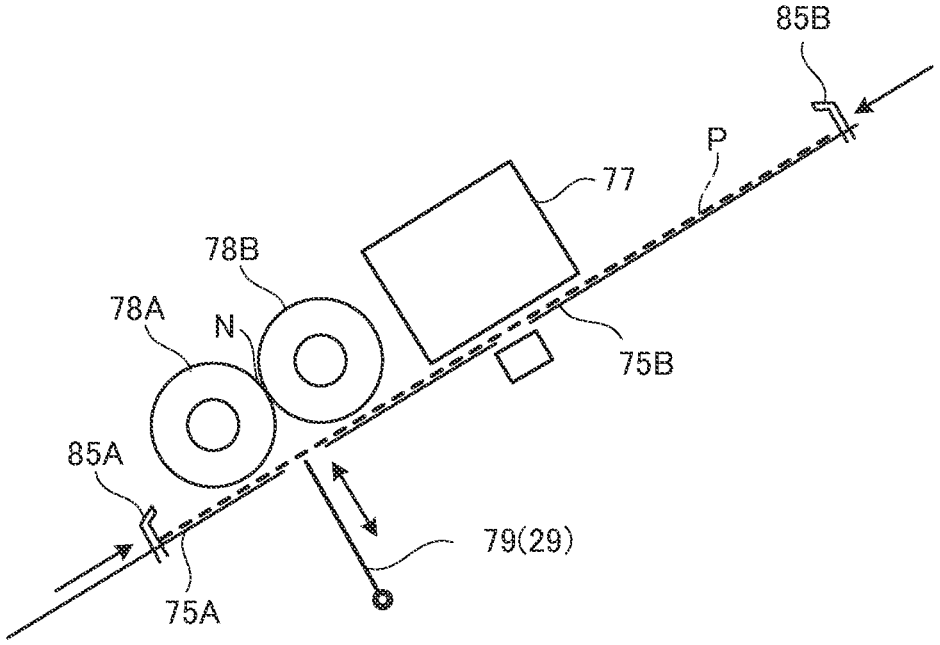

When the stapling operation is to be performed thereafter, the leading edge cursor 85A and the trailing edge cursor 85B are moved to the position shown in FIG. 3B. Accordingly, the recording sheets P are moved on the divided tables 75A and 75B, such that the center of the recording sheets P is set at the position for the stapling operation by the stapling device 77, and the stapling device 77 performs the stapling operation onto the center of the recording sheets P.

Figure 3C:
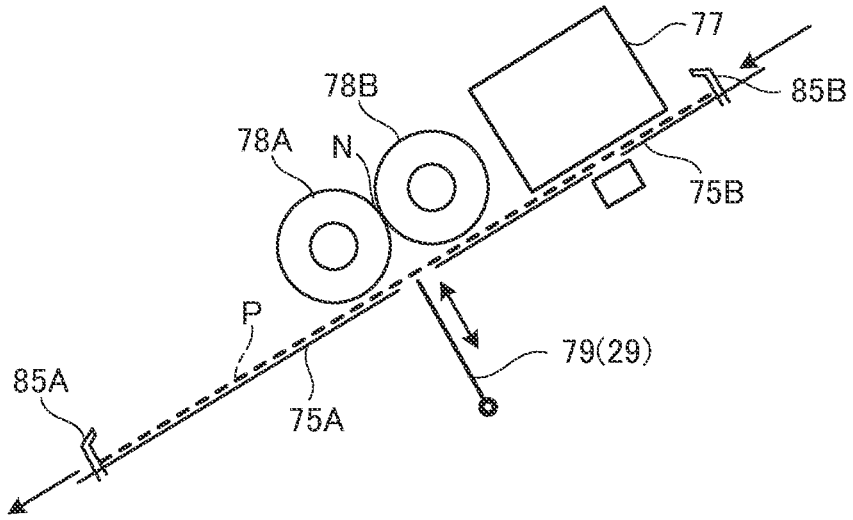
FIG. 3C and FIG. 3D are schematic drawings for explaining the operation of the saddle binding operation, performed by the saddle binding device on the recording sheet.

Then the cursors 85A and 85B are moved, so that the position of the recording sheets P on the divided tables 75A and 75B is shifted, as shown in FIG. 3C. As result, the center of the recording sheet P in the sheet transport direction is set in position, in the space between the divided tables 75A and 75B.

Figure 3D:
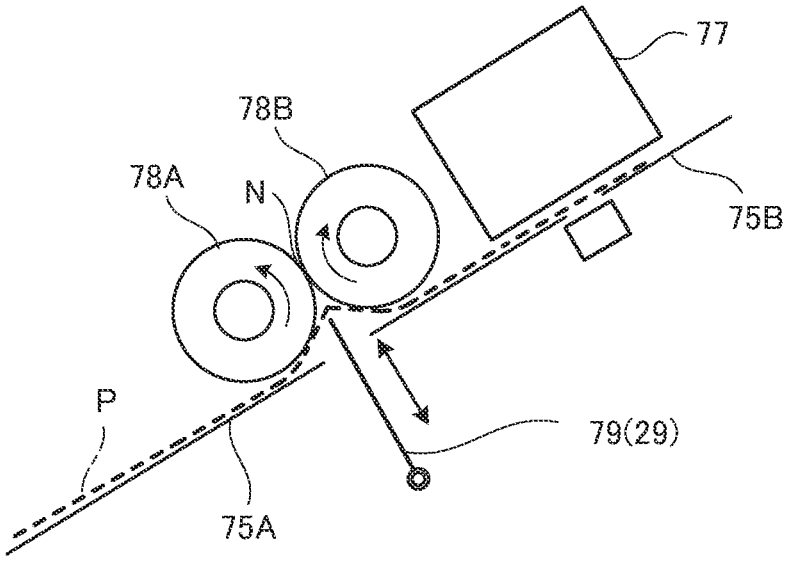

Proceeding to FIG. 3D, the folding roller 78A is driven to rotate counterclockwise in FIG. 3D, and the folding roller 78B is driven to rotate clockwise in FIG. 3D. The folding blade 79 is located at the position corresponding to the nip region N between the folding rollers 78A and 78B. When the folding blade 79 is moved toward the recording sheets P and then toward the nip region N, the central portion of the recording sheets P is lifted up by the tip portion of the folding blade 79. As result, the central portion of the recording sheets P is squeezed into the nip region N between the folding rollers 78A and 78B, and the recording sheets P are folded along the center by the folding rollers 78A and 78B, thus to be double-folded. The recording sheets P folded as above are transported by the folding rollers 78A and 78B, and then guided by the guide 81 to the delivery conveyor 83, which transports and delivers the recording sheets P to the output tray 28.

Here, the folding roller 78C shown in FIG. 2 serves to fold the recording sheets P along an additional position after the recording sheets P are double-folded, thereby triple-folding the same. However, the description of the triple-folding operation will be skipped.

Figure 4:
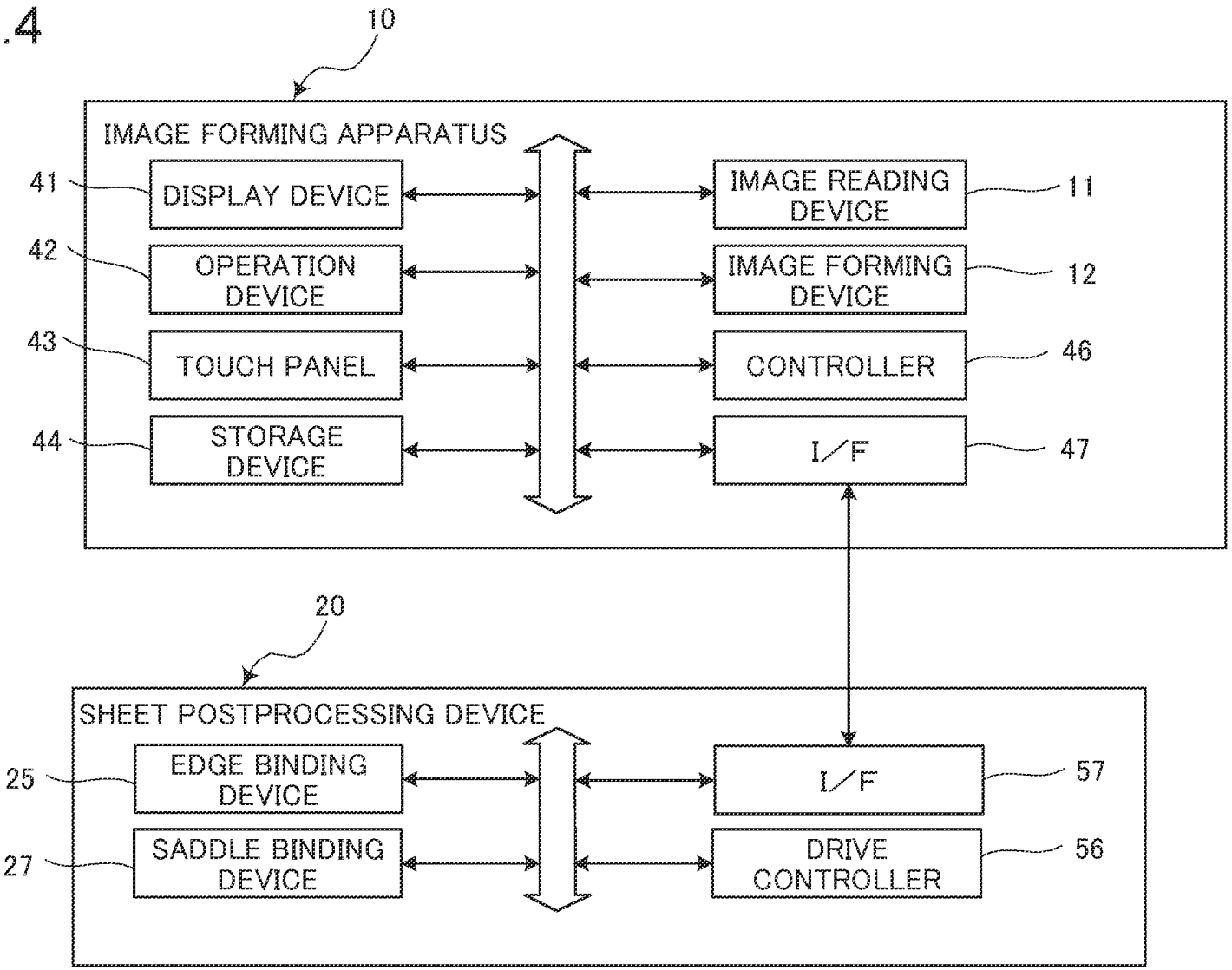
FIG. 4 is a functional block diagram showing an essential internal configuration of an image forming apparatus and the sheet postprocessing device.

Hereunder, a configuration related to the control operation of the image forming apparatus 10 and the sheet postprocessing device 20 will be described. FIG. 4 is a functional block diagram showing an essential internal configuration of the image forming apparatus 10 and the sheet postprocessing device 20. As shown in FIG. 4, the image forming apparatus 10 includes the image reading device 11, the image forming device 12, a display device 41, an operation device 42, a touch panel 43, a storage device 44, a controller 46, and an interface (hereinafter, I/F) 47. The mentioned components are configured to transmit and receive data and signals to and from each other, via a bus.

The display device 41 is, for example, constituted of a liquid crystal display (LCD) or an organic light-emitting diode (OLED) display.

The operation device 42 includes physical keys such as a numeric keypad, an enter key, and a start key. The operation device 42 receives inputs of various instructions, corresponding to the user's operation performed on the mentioned keys.

A touch panel 43 is overlaid on the screen of the display device 41. The touch panel 43 is based on what is known as a resistive film or electrostatic capacitance, and configured to detect a contact (touch) of the user's finger made thereon, along with the touched position, and output a detection signal indicating the coordinate of the touched position, to the controller 46.

The storage device 44 is a large-capacity storage device such as a solid-state drive (SSD) or a hard disk drive (HDD), and contains various application programs and various types of data.

The controller 46 includes a processor, a random-access memory (RAM), a read-only memory (ROM), and so forth. The processor is, for example, a central processing unit (CPU), an application specific integrated circuit (ASIC), or a micro processing unit (MPU). The controller 46 acts as a processing device that executes the control program stored in the ROM or the storage device 44, thereby executing various processings necessary for the image forming job by the image forming apparatus 10.

The controller 46 is connected to the image reading device 11, the image forming device 12, the display device 41, the operation device 42, the touch panel 43, the storage device 44, and the I/F 47. The controller 46 controls the operation of the components cited above, and transmits and receives signals and data to and from those components.

The controller 46 is also configured to control the displaying operation of the display device 41. Further, the controller 46 receives the instruction inputted by the user, on the basis of the detection signal outputted from the touch panel 43 or a press of the physical key on the operation device 42. For example, the controller 46 receives the instruction according to a touch operation, performed through the touch panel 43 on the graphical user interface (GUI) displayed on the screen of the display device 41.

The sheet postprocessing device 20 includes the edge binding device 25, the saddle binding device 27, a drive controller 56, and an I/F 57. These components are configured to transmit and receive data and signals to and from each other, via a bus.

The drive controller 56 includes a processor, a RAM, and a ROM, and controls the operation of the edge binding device 25 and the saddle binding device 27.

The controller 46 of the image forming apparatus 10 and the drive controller 56 of the sheet postprocessing device 20 are configured to input and output data and signals between each other, via the respective I/Fs 47 and 57. For example, the controller 46 of the image forming apparatus 10 outputs a control signal, indicating the postprocessing to be performed by the sheet postprocessing device 20 and the size of the recording sheet P, to the drive controller 56 of the sheet postprocessing device 20, and the drive controller 56 of the sheet postprocessing device 20 controls the edge binding device 25 or the saddle binding device 27, according to the control signal received.

In the image forming system Sy configured as above, for example when the image forming apparatus 10 is made to read the images of a plurality of documents M and form the respective images on the recording sheets P, and the saddle binding device 27 of the sheet postprocessing device 20 is made to perform the saddle binding operation including binding the central position of the recording sheets P and folding the recording sheets P at the central position, an instruction to perform the saddle binding operation, and designation of the size (length and width) of the recording sheet P are inputted through the touch panel 43, on the basis of the user's operation performed on the GUI displayed on the screen of the display device 41. Then the user sets a plurality of documents M on the image reading device 11, and inputs an instruction to execute a copying operation, through the operation device 42. The controller 46 receives the instruction to perform the saddle binding operation, the designation of the size of the recording sheet P, and the instruction to execute the copying operation.

The controller 46 of the image forming apparatus 10 outputs a control signal indicating the instruction to perform the saddle binding operation and the size of the recording sheet P to the sheet postprocessing device 20 through the I/F 47. The controller 46 also causes the image reading device 11 to sequentially read the images of the respective documents M, causes the image forming device 12 to form those images on the respective recording sheets P, and sequentially delivers the recording sheets P, each having the image formed thereon, to the sheet postprocessing device 20.

The drive controller 56 of the sheet postprocessing device 20 receives the instruction to perform the saddle binding operation and the size of the recording sheet P, through the I/F 57. Then the drive controller 56 drives the plurality of transport rollers 21, the branching nail 24, and the delivery roller 23, so as to transport the recording sheets P, delivered from the image forming apparatus 10, to the saddle binding device 27 according to the control signal received. Further, the drive controller 56 activates motors that respectively serve as drive sources for the revolving belts 76A and 76B, the stapling device 77, the folding rollers 78A and 78B, the folding blade 79, the delivery conveyor 83, the side-edge cursors 91A and 91B, and the blowing fan 93, in the saddle binding device 27. As result, the stapling operation is performed on the center of the recording sheet P in the sheet transport direction, and the recording sheets P are folded along the center and delivered to the output tray 28.

For example, a stepping motor may be employed, as the drive source for the side-edge cursors 91A and 91B. In addition, a conversion mechanism may be provided that converts the rotative force of the stepping motor, into linear driving force that causes the side-edge cursors 91A and 91B to move toward and away from each other. Such conversion mechanism provides the driving force for linear movement, to the side-edge cursors 91A and 91B.

The conversion mechanism includes, for example, rack gears respectively connected to the side-edge cursors 91A and 91B. The rack gear is attached to each of the side-edge cursors 91A and 91B, so as to extend toward the other cursor. Such rack gears are oriented parallel to each other, and movable, together with the cursor, in the width direction orthogonal to the sheet delivery direction. The rack gears are each meshed with a pinion gear. The conversion mechanism is configured to rotate the pinion gear in the forward or reverse direction, thereby moving the corresponding rack gear in the width direction, so that the side-edge cursors 91A and 91B are moved toward or away from each other. The pinion gear can be made to rotate in the forward or reverse direction, by the stepping motor.

The drive controller 56 moves the side-edge cursors 91A and 91B, by controlling the rotation direction and the rotation angle of the stepping motor. To be more specific, the drive controller 56 controls the rotation direction and the rotation angle of the stepping motor, to thereby move the side-edge cursors 91A and 91B to a standby position, where the cursors are most distant from each other. The position of each of the side-edge cursors 91A and 91B in the width direction is detected by a non-illustrated sensor (e.g., optical sensor). The drive controller 56 moves the side-edge cursors 91A and 91B to the standby position, on the basis of the detection output from the sensor. Then the drive controller 56 moves the side-edge cursors 91A and 91B from the standby position, toward each other by a distant determined according to the width of the recording sheet P. Thus, the drive controller 56 moves the side-edge cursors 91A and 91B in the width direction, to the position where the cursors make contact with the respective side edges of the recording sheet P, thereby regulating the position in the width direction, of the recording sheet P delivered to the divided tables 75A and 75B.

A stepping motor may also be employed as a belt drive source for causing the revolving belt 76A to revolve endlessly. The revolving belt 76A is provided with a mechanism (e.g., gear unit and pulley) that transmits the rotation of the stepping motor to the revolving belt 76A. The drive controller 56 causes the revolving belt 76A to revolve, thereby moving the leading edge cursor 85A mounted on the revolving belt 76A, by controlling the rotation direction and the rotation angle of the stepping motor. The position of the leading edge cursor 85A is detected by a non-illustrated sensor. The drive controller 56 controls the action of the stepping motor on the basis of the detection output from the sensor, thereby moving the leading edge cursor 85A to a predetermined standby position.

Likewise, another stepping motor may be employed as a belt drive source for the revolving belt 76B. The revolving belt 76B is provided with a mechanism (e.g., a gear unit and a pulley) that transmits the rotation of the stepping motor to the revolving belt 76B. The drive controller 56 causes the revolving belt 76B to revolve, thereby moving the trailing edge cursor 85B mounted on the revolving belt 76B, by controlling the rotation direction and the rotation angle of the stepping motor. The position of the trailing edge cursor 85B is detected by a non-illustrated sensor. The drive controller 56 controls the action of the stepping motor on the basis of the detection output from the sensor, thereby moving the trailing edge cursor 85B to a predetermined standby position.

When the recording sheet P is delivered to the divided tables 75A and 75B, with the cursors 85A and 85B set at the standby position, the leading edge of the recording sheet P is abutted against the leading edge cursor 85A. At this point, the drive controller 56 drives the cursor drive source, so as to move the side-edge cursors 91A and 91B to the contact position with the respective side edges of the recording sheet P. Accordingly, the recording sheet P is set in position, in the width direction. Then the drive controller 56 either causes the revolving belt 76A to revolve, thereby moving the leading edge cursor 85A toward the trailing edge cursor 85B, by controlling the rotation direction and the rotation angle of the belt drive source for the revolving belt 76A, or causes the revolving belt 76B to revolve, thereby moving the trailing edge cursor 85B toward the leading edge cursor 85A, by controlling the rotation direction and the rotation angle of the belt drive source for the revolving belt 76B. As result, the trailing edge of the recording sheet P is abutted against the trailing edge cursor 85B. At this point, the drive controller 56 moves the trailing edge cursor 85B in the direction away from the leading edge cursor 85A, toward a position spaced therefrom by a distance slightly longer than the length of the recording sheet P. As result, the trailing edge of the recording sheet P is set in position by the trailing edge cursor 85B, as shown in FIG. 3B. The drive controller 56 then moves the leading edge cursor 85A and the trailing edge cursor 85B to the respective standby positions. At this point, the recording sheet P remains abutted against the leading edge cursor 85A, on the divided tables 75A and 75B.

The mentioned operation is repeated each time one recording sheet P is delivered to the divided tables 75A and 75B, so that a plurality of recording sheets P are stacked on the divided tables 75A and 75B, with the respective edges aligned with each other. Thereafter, the drive controller 56 moves the recording sheets P on the divided tables 75A and 75B using the leading edge cursor 85A and the trailing edge cursor 85B, by controlling the rotation direction and the rotation angle of the respective belt drive sources for the revolving belts 76A and 76B, such that, as shown in FIG. 3B, the center of the recording sheet P in the longitudinal direction (i.e., sheet delivery direction), in other words the position on the recording sheet P, spaced from the leading edge cursor 85A by a distance corresponding to a half of the length of the recording sheet P, is positioned for the stapling operation by the stapling device 77.

Then the drive controller 56 causes the stapling device 77 to perform the stapling operation, onto the center of the recording sheets P. Thereafter, the drive controller 56 moves the center of the recording sheets P in the longitudinal direction using the leading edge cursor 85A and the trailing edge cursor 85B, to the position corresponding to the space between the folding rollers 78A and 78B as shown in FIG. 3C, by controlling the rotation direction and the rotation angle of the respective belt drive sources for the revolving belts 76A and 76B, Further, a linear movement mechanism, configured to convert the rotation of the motor serving as the blade drive source, to the linear movement of the folding blade 79, is provided. The linear movement mechanism supports the folding blade 79 so as to move toward and away from the nip region N between the folding rollers 78A and 78B, and includes a coil spring biasing the folding blade 79 in the direction away from the nip region N. The linear movement mechanism includes a cam that pushes the end portion of the folding blade 79 on the opposite side of the nip region N, in other words the rear end portion of the folding blade 79, thereby moving the folding blade 79 toward the nip region N, against the biasing force of the coil sprint. The cam is made to rotate in one direction, by the driving force of the motor. The drive controller 56 sets the folding blade 79 at the standby position, by controlling the rotation of the motor. The position of the folding blade 79 is detected by a non-illustrated sensor (e.g., optical sensor). The drive controller 56 sets the folding blade 79 at the standby position most distant from the nip region N between the folding rollers 78A and 78B, on the basis of the detection output from the sensor.

The drive controller 56 causes the folding blade 79 to move from the standby position shown in FIG. 3C to the position closest to the nip region N shown in FIG. 3D, thereby causing the folding blade 79 to squeeze the central portion of the recording sheets P into the nip region N between the folding rollers 78A and 78B. Thereafter, the drive controller 56 returns the folding blade 79 to the standby position.

In addition, a known transmission mechanism (e.g., gear unit) is provided that converts the rotation of the motor serving as the drive source for each of the folding rollers 78A and 78B, to the counterclockwise rotation of the folding roller 78A and the clockwise rotation of the folding roller 78B. The drive controller 56 controls the rotation of such motors, thereby causing the folding roller 78A to rotate counterclockwise in FIG. 3D, and causing the folding roller 78B to rotate clockwise in FIG. 3D. As result, the recording sheets P are caught between the nip region N, thus to be folded along the center of the recording sheets P.

The drive controller 56 causes the delivery conveyor 83 to deliver the recording sheet P folded as above to the output tray 28, by controlling the rotation of the motor serving as the drive source for the delivery conveyor 83.

Referring now to FIG. 5 to FIG. 12B, the configuration of the saddle binding device 27 of the sheet postprocessing device 20 will be described in detail.

Figure 5:
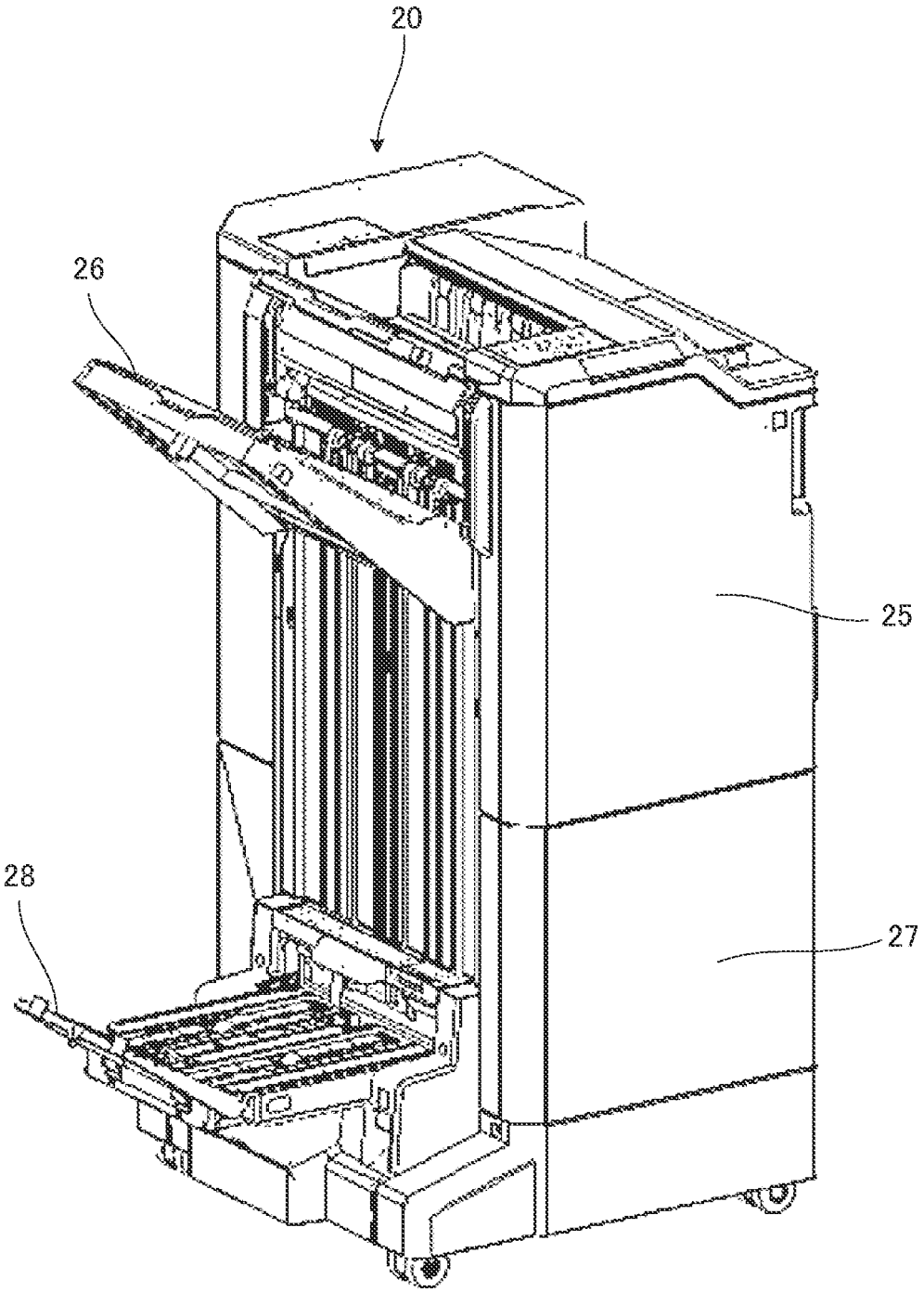
FIG. 5 is a perspective view showing the appearance of the sheet postprocessing device.

FIG. 5 is a perspective view showing the sheet postprocessing device 20. As shown in FIG. 5, the edge binding device 25 and the output tray 26 are provided in the upper portion of the sheet postprocessing device 20, and the saddle binding device 27 and the output tray 28 are provided in the lower portion of the sheet postprocessing device 20.

Figure 6A:
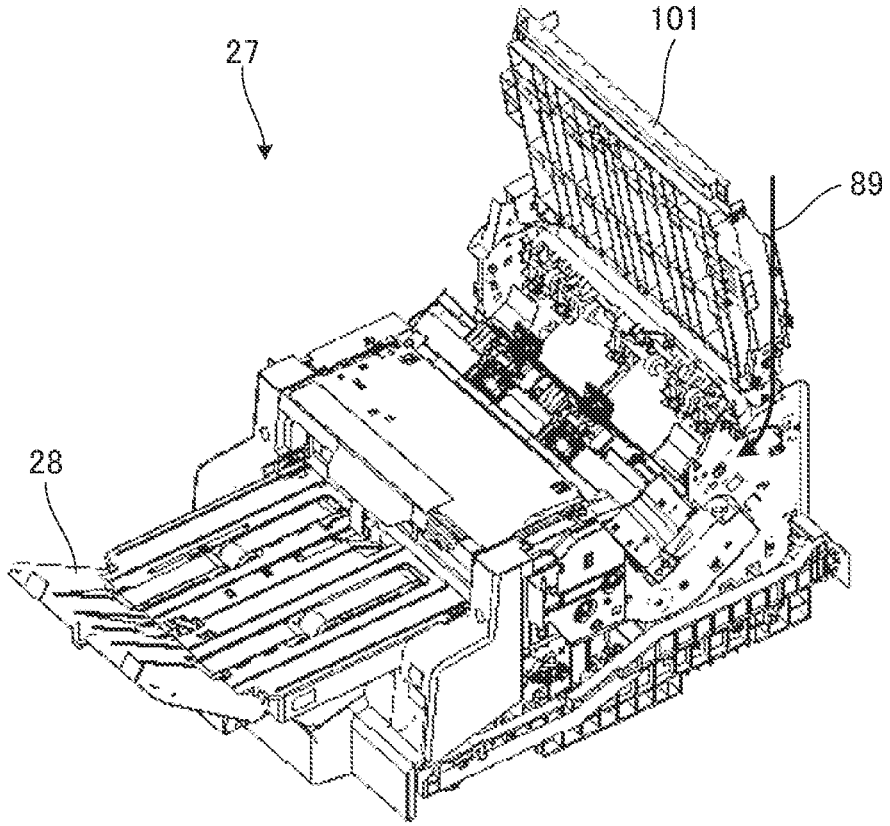
FIG. 6A is a front perspective view of the saddle binding device seen from an obliquely upper position.
Figure 6B:
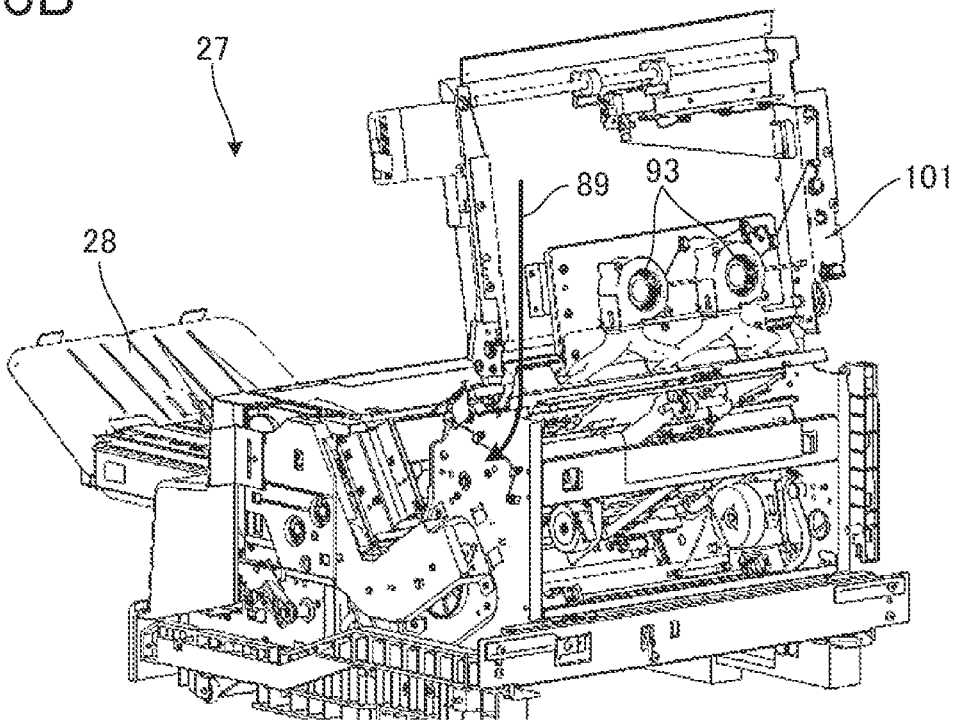
FIG. 6B is a perspective view of the saddle binding device seen from the back, with a back cover thereof opened upward.

FIG. 6A is a perspective view of the saddle binding device 27, seen from an obliquely upper position on the side to which the recording sheet P is delivered (front side). FIG. 6B is a perspective view of the saddle binding device 27 seen from the back. FIG. 6A and FIG. 6B illustrate the state where a back cover 101 of the saddle binding device 27 is opened upward.

The recording sheet P is transported downward along a transport route 89 provided on the rear side of the sheet postprocessing device 20 as shown in FIGS. 6A and 6B, toward the saddle binding device 27 on the lower side. Two blowing fans 93 are provided on the back cover 101 of the saddle binding device 27. When the cover 101 is closed, the blowing fans 93 are oriented toward the divided tables 75A and 75B, as shown in FIG. 2. When the blowing fans 93 rotate in this state, the air emitted by the blowing fans 93 flows along the upper face of the divided tables 75A and 75B, through the outlet of the transport route 89.

To the output tray 28, the recording sheets P, bound and folded by the saddle binding device 27, are delivered.

Figure 7:
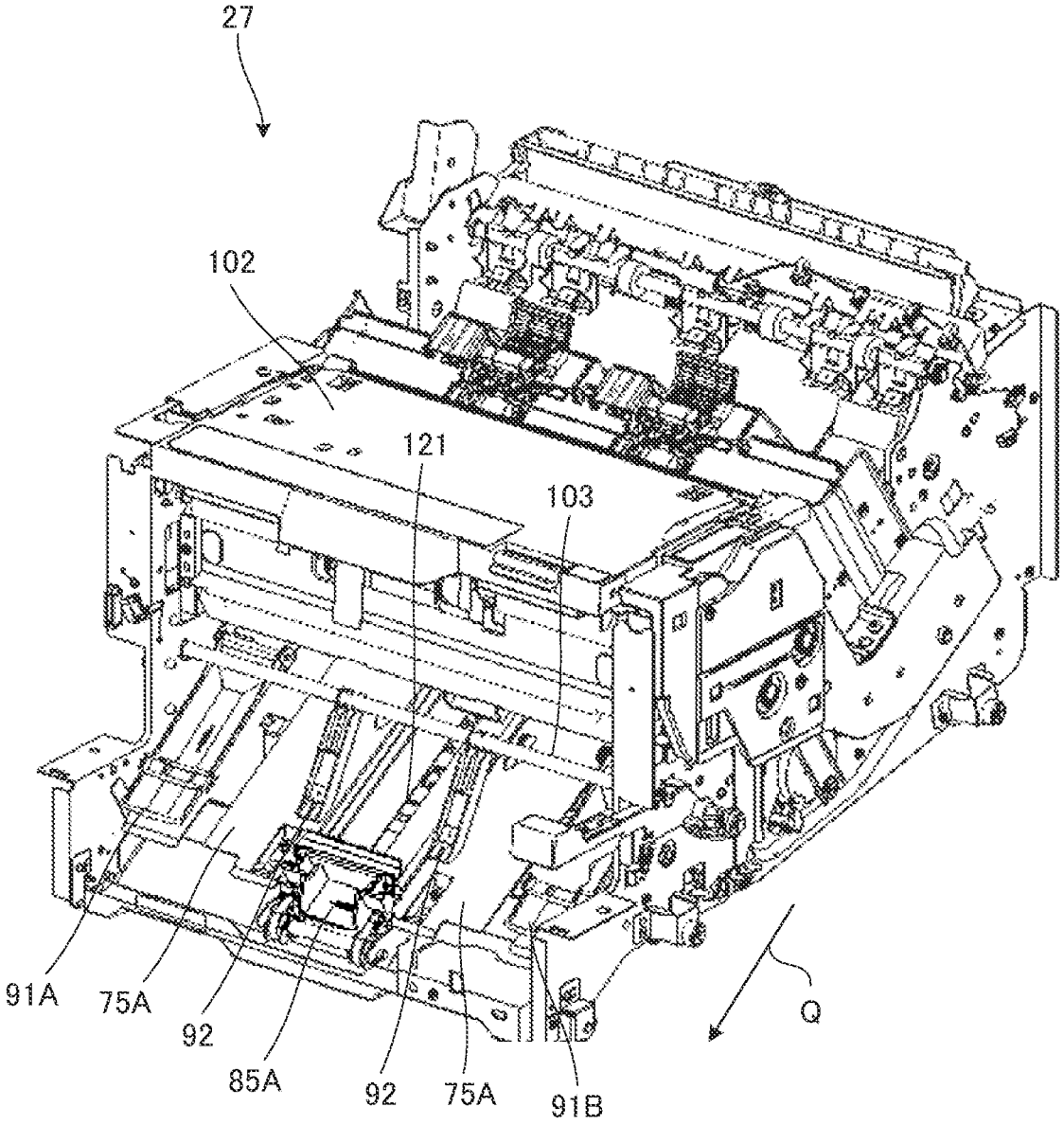
FIG. 7 is a front perspective view of the saddle binding device seen from an obliquely upper position, with an output tray excluded.
Figure 8:
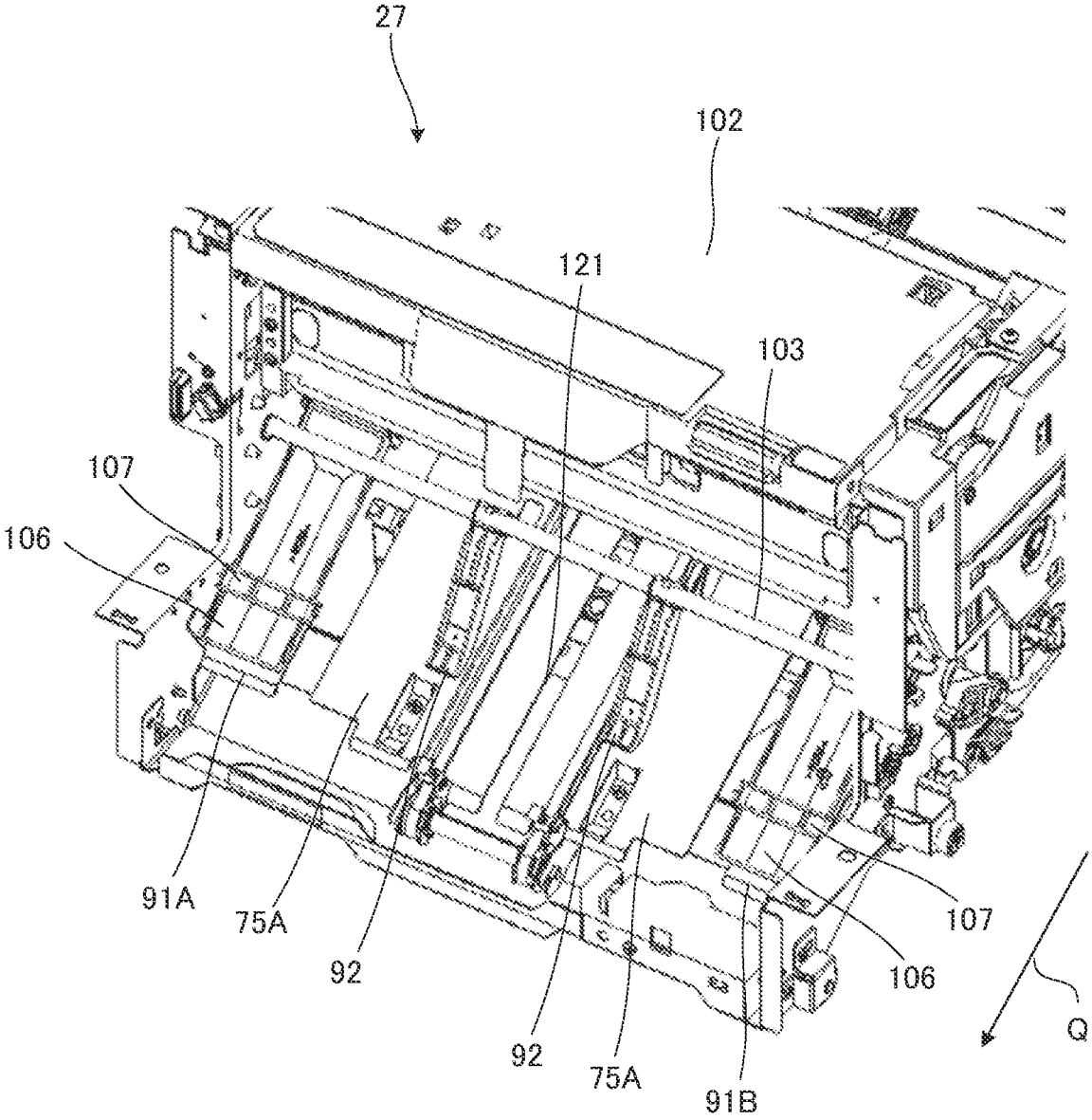
FIG. 8 is an enlarged front perspective view of a divided table and related parts in the saddle binding device, seen from an obliquely upper position.
Figure 9:
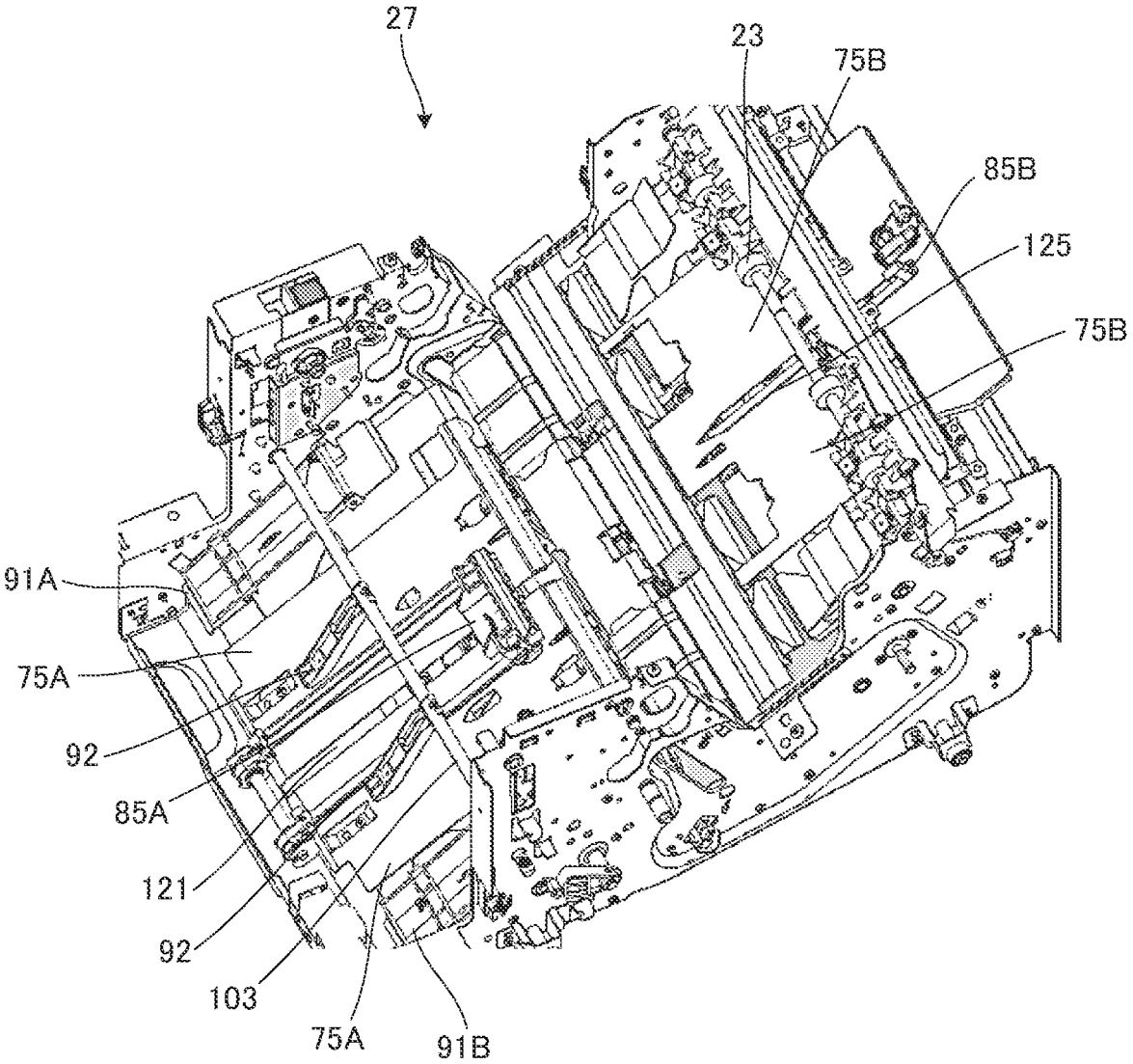
FIG. 9 is a front perspective view of the saddle binding device seen from an obliquely upper position, with an upper cover excluded.

FIG. 7 is a perspective view of the saddle binding device 27 seen from an obliquely upper position, with the output tray 28 shown in FIG. 6 excluded. FIG. 8 is an enlarged front perspective view of the divided table 75A and related parts in the saddle binding device 27, seen from an obliquely upper position. FIG. 9 is a perspective view of the saddle binding device 27, seen from a further upper position than in FIG. 7 and FIG. 8, with the upper cover 102 shown in FIG. 7 and FIG. 8 excluded.

As shown in FIG. 7 to FIG. 9, a shaft 103, extending in the direction orthogonal to the delivery direction Q of the recording sheet P, is provided above the divided table 75A, and the end portions of the shaft 103 are supported by frames on the respective sides of the saddle binding device 27. The shaft 103 is passed through the rear end portion of each of the two first pressing members 92 in the delivery direction, thus to pivotably support the first pressing members 92. The clearance between the first pressing members 92 is determined such that the respective positions of the first pressing members 92 remain within the width of the narrowest recording sheet P to be delivered to the divided table 75A.

Figure 10:
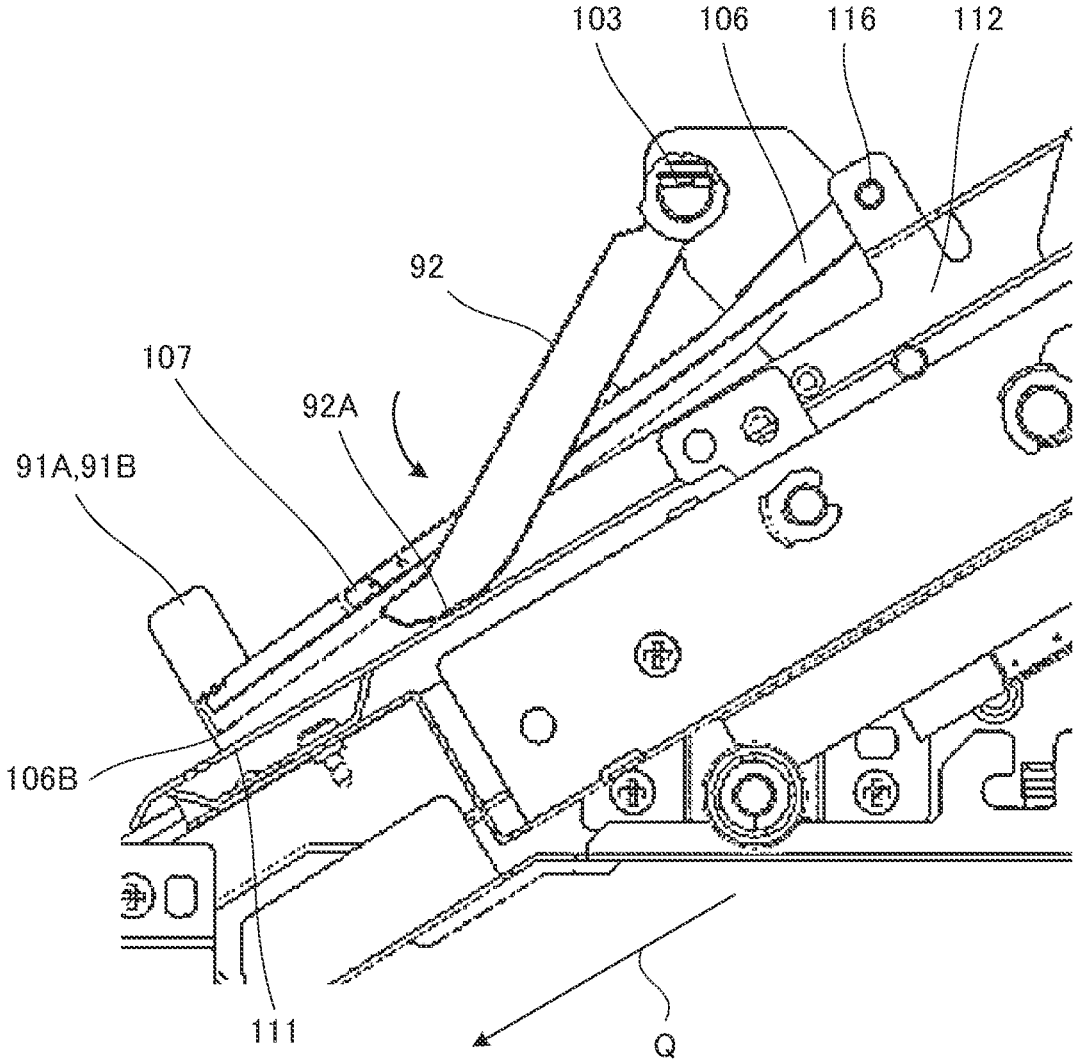
FIG. 10 is a side view showing a first pressing member and related parts, in the saddle binding device.

FIG. 10 is an enlarged side view showing the first pressing member 92 and the related parts. As shown in FIG. 10, the distal end portion of each of the first pressing members 92 is pressed against the divided table 75A, because of the self-weight. In other words, the first pressing members 92 are biased toward the divided table 75A, by the self-weight thereof. The first pressing members 92 each pivot counterclockwise in FIG. 10 about the shaft 103, because of the self-weight, such that the distal end portion 92A is abutted against the divided table 75A. The distal end portion 92A of each of the first pressing member 92 is formed in a smoothly curved arcuate shape, protruding downward when viewed along the width direction of the recording sheet P. Thus, the first pressing members 92 are located above the divided table 75A, and supported so as to pivot toward and away from the divided table 75A, about the end portion on the upstream side in the delivery direction serving as the pivotal fulcrum.

Referring again to FIG. 7 to FIG. 9, the side-edge cursor 91A is provided on one side of the divided table 75A, and the side-edge cursor 91B is provided on the other side of the divided table 75A. Under the divided table 75A, the conversion mechanism is located. The conversion mechanism moves the side-edge cursors 91A and 91B from the corresponding standby position on the respective sides of the divided table 75A, so as to come closer to each other, thereby regulating the positions of the respective side edges of the recording sheet P in the width direction, using the side-edge cursors 91A and 91B.

Figure 11A:
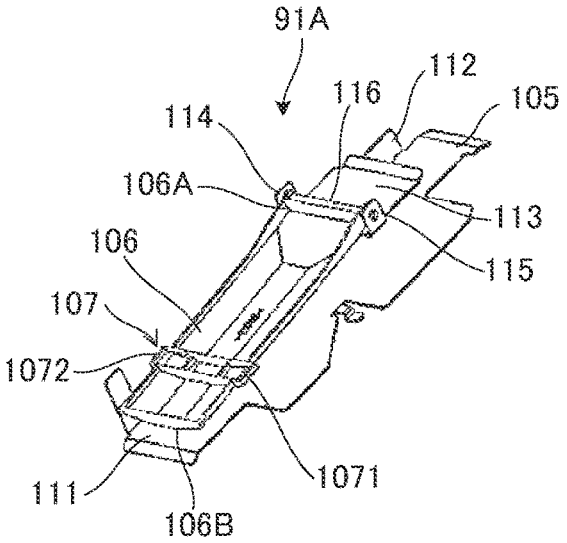
FIG. 11A and FIG. 11B are perspective views showing respective side-edge cursors in the saddle binding device.
Figure 11B:
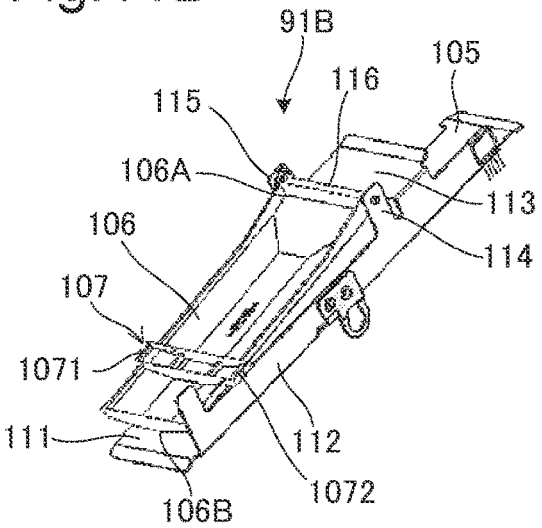
Figure 11C:
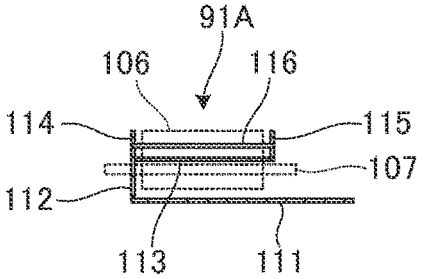
FIG. 11C and FIG. 11D are cross-sectional views showing the respective side-edge cursors.
Figure 11D:
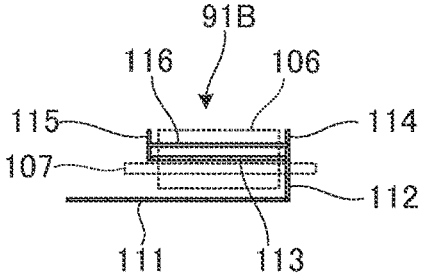
Figure 11E:
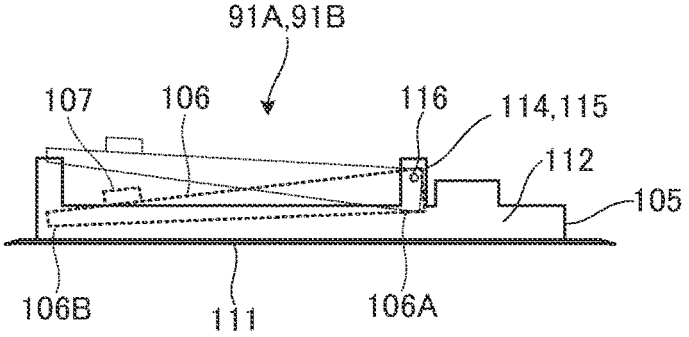
FIG. 11E is a side view showing the side-edge cursors.

The configuration of the side-edge cursors 91A and 91B will be described in further detail hereunder. FIG. 11A and FIG. 11B are perspective views respectively showing the side-edge cursors 91A and 91B. FIG. 11C and FIG. 11D are cross-sectional views respectively showing the side-edge cursors 91A and 91B. FIG. 11E is a side view showing the side-edge cursors 91A and 91B.

As shown in FIG. 11A to FIG. 11E, the side-edge cursors 91A and 91B each include a cursor main body 105, a second pressing member 106, and a stopper 107. The cursor main body 105 includes a bottom plate 111, the side-edge plate 112 bent upward from an outer edge of the bottom plate 111, and a top plate 113 bent inwardly from an upper edge of the side-edge plate 112, and the bottom plate 111 and the top plate 113 are opposed to each other in the up-down direction, with a spacing therebetween. The bottom plate 111 is oriented parallel to the upper face of the divided table 75A. The bottom plate 111 corresponds to the surface on which the recording sheet P is placed. The side-edge plate 112 is erected along the outer edge of the bottom plate 111 in the width direction, to be in contact with the side edge of the recording sheet P placed on the bottom plate 111. The side-edge plate 112 regulates the position of the side edge of the recording sheet P, upon making contact with the side edge of the recording sheet P. The second pressing member 106 is formed along the side-edge plate 112 on the upper side of the bottom plate 111, and supported so as to pivot toward and away from the bottom plate 111, about the end portion on the upstream side in the delivery direction serving as the pivotal fulcrum.

The side-edge plate 112 includes a support piece 114 protruding upward, and the top plate 113 also includes a support piece 115 bent and protruding upward. The support pieces 114 and 115 serve to support a shaft 116, which is passed through the rear end portion 106A of the second pressing member 106, to support the second pressing member 106 so as to pivot about the shaft 116.

When the recording sheet P is delivered to the divided table 75A through the delivery roller 23, the leading edge of the recording sheet P in the delivery direction enters into between the bottom plate 111 and the top plate 113 spaced from each other, and thus the recording sheet P is placed on the bottom plate 111.

The stopper 107 is fixed to the top portion of the second pressing member 106, such that the end portions of the stopper 107 in the width direction are protruding from the second pressing member 106. The stopper 107 includes an inner protrusion 1071, protruding toward the first pressing member 92 in the width direction, from the end portion of the second pressing member 106 on the side of the first pressing member 92. The stopper 107 also includes an outer protrusion 1072 protruding toward the side edge of the divided table 75A in the width direction.

The second pressing member 106 is biased by the self-weight thereof, thus to be pressed against the bottom plate 111. In other words, the second pressing member 106 is biased toward the bottom plate 111 by the self-weight thereof, and set to pivot counterclockwise in FIG. 11E, about the shaft 116. In addition, the inner protrusion 1071, one of the end portions of the stopper 107 in the width direction, is protruding toward the first pressing member 92, and the outer protrusion 1072, the other end portion of the stopper 107 in the width direction, is protruding toward the side-edge plate 112 of the cursor main body 105. The outer protrusion 1072 of the stopper 107 makes contact with the upper edge of the side-edge plate 112 of the cursor main body 105, thus to delimit the pivotal movement of the distal end portion 106B of the second pressing member 106, so as to set the second pressing member 106 at a position spaced from the bottom plate 111 of the cursor main body 105 by a predetermined distance.

Referring again to FIG. 10, the distal end portion 106B of the second pressing member 106 is located downstream of the distal end portion 92A of the first pressing member 92, in the delivery direction. In other words, in the delivery direction Q of the recording sheet P, the position where the distal end portion 106B of the second pressing member 106 presses the recording sheet P (second pressing position) is located downstream of the position where the distal end portion 92A of the first pressing member 92 presses the recording sheet P (first pressing position). Thus, the position where the distal end portion 92A of the first pressing member 92 presses the recording sheet P and the position where the distal end portion 106B of the second pressing member 106 presses the recording sheet P are different from each other.

Further, as shown in FIG. 7 to FIG. 9, the divided table 75A includes a slit 121, formed at the central portion thereof in the width direction. The leading edge cursor 85A is connected to the revolving belt 76A located under the divided table 75A, through the slit 121. When the revolving belt 76A is made to revolve by the motor as mentioned above, the leading edge cursor 85A is moved.

Figure 12A:
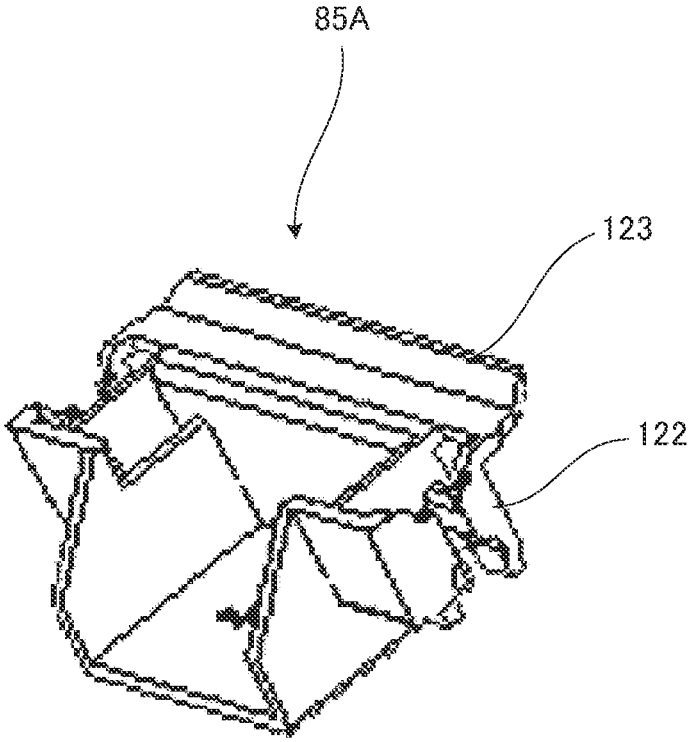
FIG. 12A and FIG. 12B are a perspective view and a side view each showing a leading edge cursor in the saddle binding device.
Figure 12B:
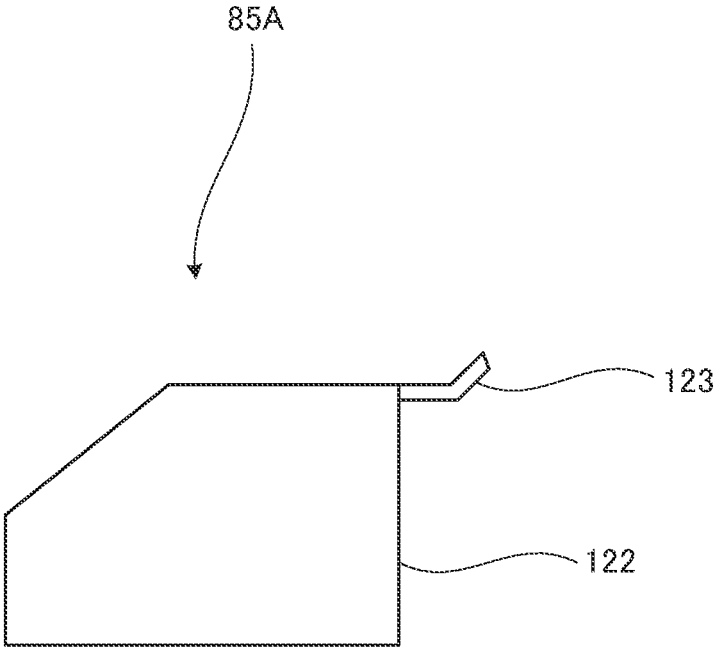

FIG. 12A and FIG. 12B are a perspective view and a side view, each showing the leading edge cursor 85A. As shown in FIG. 12A and FIG. 12B, the leading edge cursor 85A includes an abutment surface 122 against which the leading edge of the recording sheet P is abutted, and a guide piece 123 formed along the upper edge of the abutment surface 122, to guide the leading edge of the recording sheet P to the abutment surface 122.

Further, as shown in FIG. 7 to FIG. 9, the divided table 75B includes a slit 125, formed at the central portion thereof in the width direction, and the trailing edge cursor 85B is connected to the revolving belt 76B located under the divided table 75B, through the slit 125. When the revolving belt 76B is made to revolve by the motor as mentioned above, the trailing edge cursor 85B is moved.

Now, in the case where the recording sheet P delivered to the divided tables 75A and 75B is curled in the direction toward or away from the divided tables 75A and 75B, the leading edge of the recording sheet P may fail to be abutted against the leading edge cursor 85A. When the leading edge of the recording sheet P thus fails to be abutted against the leading edge cursor 85A, the positions in the delivery direction, of the respective recording sheets P stacked on the divided tables 75A and 75B, become unable to be aligned with each other.

In the saddle binding device 27 according to this embodiment, therefore, the two first pressing members 92 are provided, so that the distal end portions 92A of the respective first pressing members 92 serve to press the central portion in the width direction, of the recording sheet P delivered to the divided table 75A. Further, the leading edge of the recording sheet P delivered to the divided table 75A enters into between the bottom plate 111 and the top plate 113 of each of the side-edge cursors 91A and 91B. Then the recording sheet P enters the region under the distal end portions 106B of the respective second pressing members 106, so that the respective end portions of the recording sheet P in the width direction are pressed by the distal end portion 106B. As result, the curl of the recording sheet P, in particular in the proximity of the leading edge in the delivery direction, is corrected, which ensures that the leading edge of the recording sheet P is properly abutted against the leading edge cursor 85A.

Further, as shown in FIG. 10, since the position where the distal end portions 92A of the respective first pressing members 92 press the recording sheet P, and the position where the distal end portions 106B of the respective second pressing members 106 press the recording sheet P are shifted from each other in the delivery direction Q of the recording sheet P, the curl of the recording sheet P in the proximity of the leading edge can be corrected over an extensive range in the delivery direction, by the distal end portions 92A of the respective first pressing members 92 and the distal end portions 106B of the respective second pressing members 106. Therefore, an improved curl correction effect can be attained.

Referring now to the enlarged cross-sectional view of the saddle binding device 27 shown in FIG. 13, detailed description will be given hereunder, about the process through which the recording sheet P is delivered to the divided tables 75A and 75B thus to be placed thereon, and the leading edge of the recording sheet P is abutted against the leading edge cursor 85A in the saddle binding device 27.

Before the recording sheet P is transported to the saddle binding device 27 through the transport route 89, the drive controller 56 moves the side-edge cursors 91A and 91B from the respective standby positions most distant from each other, by a predetermined first distance according to the width of the recording sheet P, by controlling the rotation direction and the rotation angle of the respective motors serving as the drive source for the side-edge cursors 91A and 91B. The drive controller 56 also moves the side-edge plates 112 of the respective side-edge cursors 91A and 91B, to positions slightly spaced from the respective side edges in the width direction, of the recording sheet P to be delivered to the divided table 75A, by a predetermined second distance.

Figure 13:
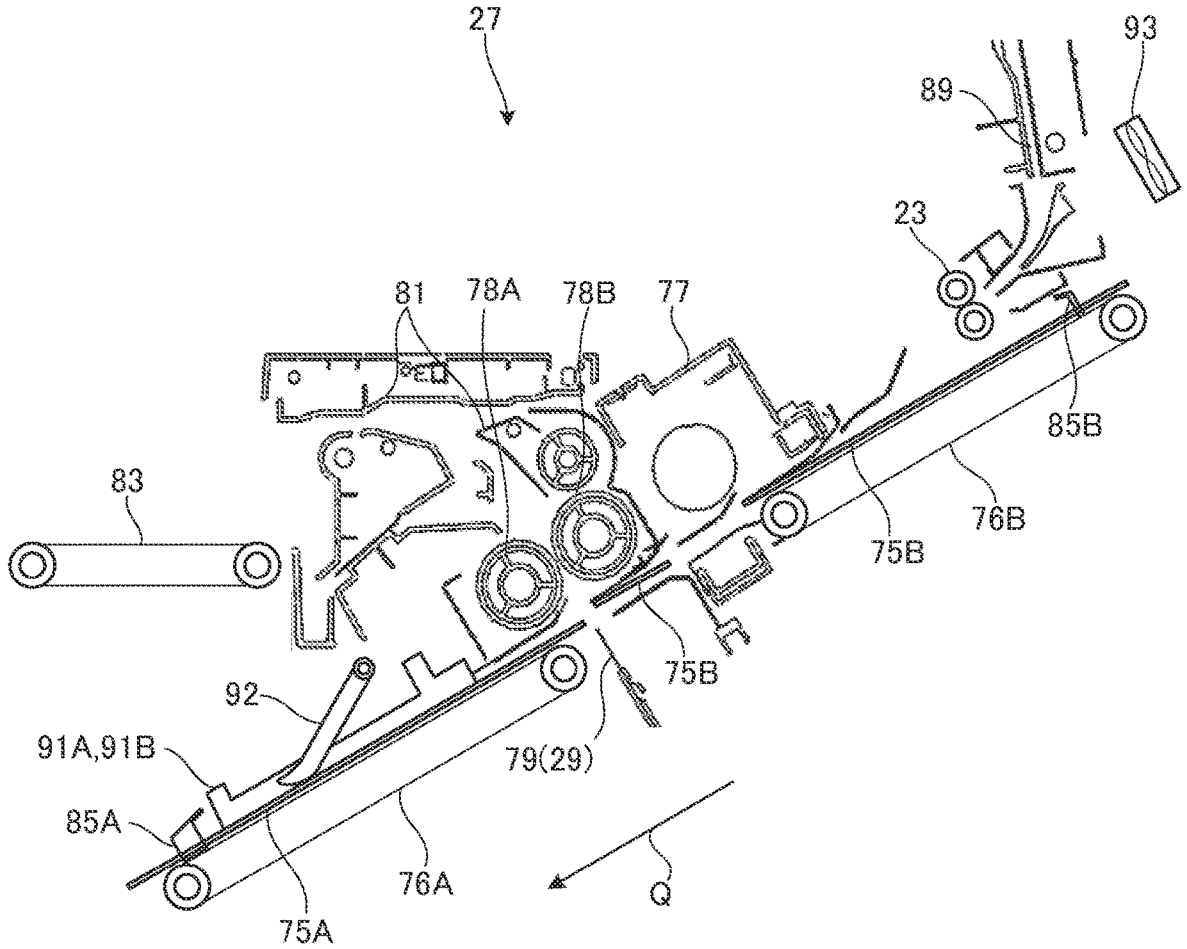
FIG. 13 is a further enlarged cross-sectional view of the saddle binding device in the sheet postprocessing device.

In addition, the drive controller 56 causes the revolving belt 76A to revolve, by controlling the rotation direction and the rotation angle of the motor serving as the drive source for the revolving belt 76A, thereby causing the leading edge cursor 85A to move to the standby position as shown in FIG. 13, and also causes the revolving belt 76B to revolve, by controlling the rotation direction and the rotation angle of the motor serving as the drive source for the revolving belt 76B, thereby causing the trailing edge cursor 85B to move to the standby position as shown in FIG. 13.

Further, the drive controller 56 drives the two blowing fans 93, thereby sending the air emitted from each of the blowing fans 93 along the upper face of the divided tables 75A and 75B, through the outlet of the transport route 89.

When the recording sheet P is transported to the saddle binding device 27 through the transport route 89 and the delivery roller 23 under the mentioned setting, the recording sheet P is delivered to the divided tables 75A and 75B, and the central portion of the leading edge of the recording sheet P passes between the distal end portions 92A of the respective first pressing members 92 and the divided table 75A, thus to reach the leading edge cursor 85A. Then the side edges of the leading edge of the recording sheet P enter the region between the side-edge cursors 91A and 91B, thus to be placed on the bottom plate 111, and the leading edge of the recording sheet P passes the region between the distal end portions 106B of the respective second pressing members 106 of the side-edge cursors 91A and 91B, and the bottom plate 111.

The distal end portions 92A of the respective first pressing members 92 press the central portion of the recording sheet P in the width direction, at the position downstream of the leading edge cursor 85A in the delivery direction Q of the recording sheet P and, at the same time, the distal end portions 106B of the respective second pressing members 106 of the side-edge cursors 91A and 91B press the respective side edges of the recording sheet P, at the position downstream of the leading edge cursor 85A in the delivery direction Q of the recording sheet P. Here, the position where the distal end portions 92A of the respective first pressing members 92 press the recording sheet P, and the position where the distal end portions 106B of the respective second pressing members 106 press the recording sheet P are shifted from each other in the delivery direction Q of the recording sheet P. Therefore, the curl of the recording sheet P in the proximity of the leading edge can be corrected over an extensive range, so that the leading edge of the recording sheet P is abutted against the leading edge cursor 85A without fail, and the recording sheet P is properly placed on the divided tables 75A and 75B.

The first pressing members 92 are each made to pivot downward by the self-weight thereof, so that the respective distal end portions 92A press the central portion of the leading edge of the recording sheet P in the width direction. Accordingly, the pressing force of the distal end portions 92A is kept from being excessive, and also the distal end portions 92A of the respective first pressing members 92 are formed in a smoothly curved shape as shown in FIG. 10. Therefore, the recording sheet P passes the region under the distal end portions 92A of the respective first pressing members 92, without being caught thereby.

Likewise, the second pressing members 106 of the respective side-edge cursors 91A and 91B are each made to pivot downward by the self-weight thereof, so that the respective distal end portions 106B press the side edges of the leading edge of the recording sheet P. Accordingly, the pressing force of the distal end portions 106B is kept from being excessive, and therefore the recording sheet P can be prevented from being damaged through the contact with the distal end portions 106B.

Further, since the side-edge plates 112 of the respective side-edge cursors 91A and 91B are slightly spaced from the respective side edges of the recording sheet P, the recording sheet P can promptly enter the region between the side-edge plates 112 of the respective side-edge cursors 91A and 91B.

The drive controller 56 moves the side-edge plates 112 of the respective side-edge cursors 91A and 91B, slightly spaced from the side edges of the recording sheet P, so as to come closer to each other, by controlling the rotation direction and the rotation angle of the motors respectively serving as the drive source for the side-edge cursors 91A and 91B. As result, the side-edge plates 112 of the respective side-edge cursors 91A and 91B are abutted against the side edges of the recording sheet P, so that the side edges of the recording sheet P in the width direction are set in position.

Then the drive controller 56 either causes the revolving belt 76A to revolve, thereby moving the leading edge cursor 85A toward the trailing edge cursor 85B, by controlling the rotation direction and the rotation angle of the stepping motor serving as the belt drive source for the revolving belt 76A, or causes the revolving belt 76B to revolve, thereby moving the trailing edge cursor 85B toward the leading edge cursor 85A, by controlling the rotation direction and the rotation angle of the stepping motor serving as the belt drive source for the revolving belt 76B. As result, the trailing edge cursor 85B is abutted against the of the trailing edge of the recording sheet P. The drive controller 56 further moves the leading edge cursor 85A and the trailing edge cursor 85B to the respective standby positions. At this point, the recording sheet P moves so as to follow the movement of the leading edge cursor 85A.

The mentioned operation is repeated thereafter, such that, each time the recording sheet P is delivered to the saddle binding device 27 through the transport route 89, the leading edge of the recording sheet P is abutted against the leading edge cursor 85A, with the curl in the proximity of the leading edge corrected, and a plurality of recording sheets P are stacked on the divided tables 75A and 75B, with the respective edges aligned with each other. Since the image forming apparatus 10 adopts the ink jet process to form the image of the source document on the recording sheet P, the recording sheet P is prone to be curled by being impregnated with the ink. However, even when the recording sheet P is wet with the ink, the sheet postprocessing device 20 corrects the curl in the proximity of the leading edge of the recording sheet P, thereby enabling the leading edge of the recording sheet P to be surely abutted against the leading edge cursor 85A.

Further, the air emitted from each of the blowing fans 93 flows along the upper face of the divided tables 75A and 75B, through the outlet of the transport route 89. Such air flows between the preceding recording sheet P already placed on the divided tables 75A and 75B, and the next recording sheet P about to be delivered through the transport route 89, and therefore the next recording sheet P is kept from making close contact with the uppermost one of the recording sheets P stacked on the divided tables 75A and 75B. In addition, even when the recording sheet P is wet with the ink, the air flowing between the recording sheets P prevents those recording sheets P from making close contact with each other.

After a plurality of recording sheets P are thus stacked, the drive controller 56 controls the action of the motors respectively serving as the drive source for the revolving belts 76A and 76B, the folding rollers 78A and 78B, the folding blade 79, and the delivery conveyor 83, thereby moving the recording sheets P on the divided tables 75A and 75B, using the leading edge cursor 85A and the trailing edge cursor 85B, so as to set the center of the recording sheets P in the longitudinal direction at the position for the stapling operation by the stapling device 77 as shown in FIG. 3B, and causing the stapling device 77 to perform the stapling operation, onto the center of the recording sheets P in the longitudinal direction. The drive controller 56 then moves the leading edge cursor 85A and the trailing edge cursor 85B, so as to set the center of the recording sheets P in the longitudinal direction at the position corresponding to the space between the divided tables 75A and 75B, as shown in FIG. 3C. Thereafter, the drive controller 56 moves the folding blade 79 toward the nip region N between the folding rollers 78A and 78B, as shown in FIG. 3D. At the same time, the drive controller 56 causes the folding rollers 78A and 78B to rotate counterclockwise and clockwise in FIG. 3D. As result, the recording sheets P are double-folded by the folding rollers 78A and 78B, and the recording sheets P thus folded are delivered from the folding rollers 78A and 78B to the output tray 28, through the delivery conveyor 83.

Further, the distal end portions 92A of the respective first pressing members 92 are formed in the smoothly curved shape. Therefore, when the recording sheets P are moved in the delivery direction on the divided tables 75A and 75B, by the leading edge cursor 85A and the trailing edge cursor 85B, the uppermost one of the recording sheets P can pass the region under the distal end portions 92A of the respective first pressing members 92, without being caught thereby.

According to the foregoing embodiment, as described above, the distal end portions 92A of the respective first pressing members 92 press the central portion in the width direction, of the recording sheet P delivered to the divided table 75A, and the distal end portions 106B of the respective second pressing members 106 of the side-edge cursors 91A and 91B press the side edges of the recording sheet P delivered to the divided table 75A. Further, the position of the distal end portion 92A of the first pressing member 92 and the position of the distal end portion 106B of the second pressing member 106 are shifted from each other in the delivery direction Q of the recording sheet P. Therefore, the curl of the recording sheet P can be corrected over an extensive range.

Figure 14:
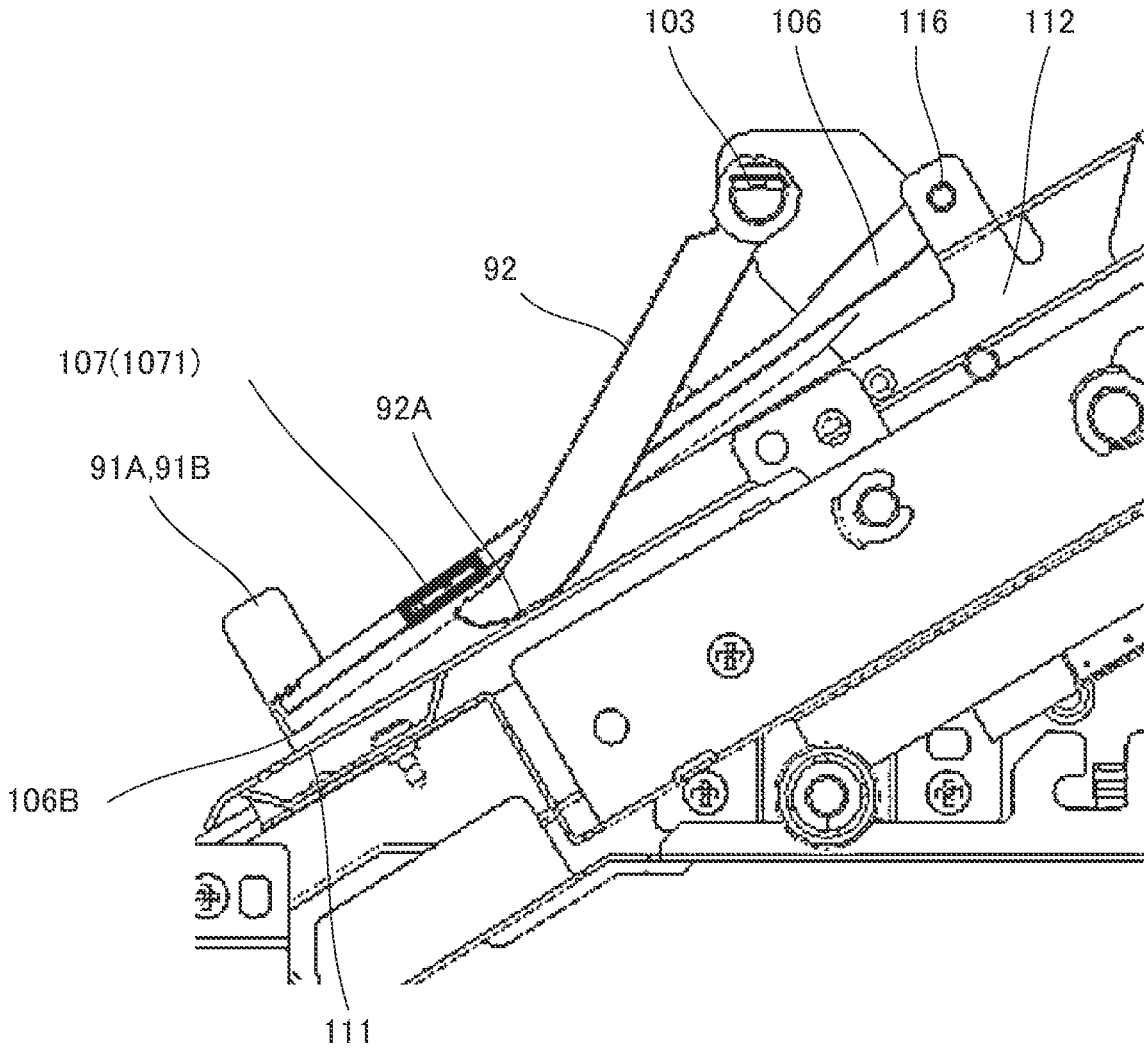
FIG. 14 is a side view showing the first pressing member and the related parts in the saddle binding device, with an end portion of a stopper protruding from a second pressing member of the side-edge cursor moved to the upper side of the distal end portion of the first pressing member.

According to the foregoing embodiment, the position of the stopper 107 in the height direction is determined such that, when the side-edge cursors 91A and 91B are moved to a predetermined regulating position closely adjacent to the respective first pressing members 92, in the state where no recording sheet P is present on the divided table 75A, the inner protrusion 1071 of the stopper 107, protruding from the second pressing member 106 of each of the side-edge cursors 91A and 91B, makes contact with the upper face of the distal end portion 92A of each of the first pressing members 92, thus to be stopped, as shown in FIG. 14. In other words, the regulating position corresponds to the position where the inner protrusion 1071 makes contact with the upper face of the distal end portion 92A. Accordingly, for example when the sheet postprocessing device 20 is to be transported to another location, undesirable vibration of the first pressing members 92 during the transport operation can be suppressed by the end portion of the stopper 107, when the operators transport the sheet postprocessing device 20, after moving the side-edge cursors 91A and 91B to the regulating position, by activating the motors respectively serving as the drive source for the side-edge cursors 91A and 91B, under the control of the drive controller 56, so as to bring the inner protrusion 1071 of the stopper 107, protruding from the second pressing member 106 of each of the side-edge cursors 91A and 91B, into contact with the upper face of the distal end portion 92A of each of the first pressing members 92.

For example, in the case of the existing sheet loading mechanism, the sheaf lifting cursor is made to reciprocate each time the sheet is delivered, so that the trailing edge of the sheet on the sheet receiving tray is kept from being contacted by the leading edge of the sheet delivered next. However, the curl of the portion in the proximity of the leading edge of the sheet being delivered to the sheet receiving tray is not corrected. When the portion in the proximity of the leading edge of the sheet is curled, the leading edge may fail to be abutted against the sheaf lifting cursor, in which case the sheets on the sheet receiving tray are unable to be aligned with each other.

Further, in the case of the existing sheet postprocessing device, air is blown through between the upper face of the uppermost one of the sheets on the sheet tray and the lower face of the next sheet being delivered to the sheet tray through the delivery guide, to prevent the next sheet from making close contact with the uppermost one of the sheets on the sheet tray. However, the curl of the portion in the proximity of the leading edge of the sheet being delivered to the sheet tray is not corrected. Accordingly, in this case also, the leading edge may fail to be abutted against the sheaf lifting cursor, and therefore the sheets on the sheet tray are unable to be aligned with each other.

In particular, when the image is formed on the sheet through the ink jet process, the sheet is more prone to be curled, and therefore it becomes more difficult to align the sheets with each other.

With the configuration according to the foregoing embodiment, in contrast, the curl of the sheet can be corrected, so that the leading edge of the sheet can be surely abutted against the cursor for aligning the leading edges. As result, the leading edges of the respective sheets can be aligned with each other, without fail.

Although the sheet postprocessing device 20 includes the drive controller 56 in the foregoing embodiment, the drive controller 56 may be excluded, and the controller 46 may be configured to directly control the sheet postprocessing device 20. In this case, the controller 46 corresponds to the drive controller in the disclosure.

Although the image forming apparatus 10 is exemplified by the image forming apparatus based on the ink jet process in the foregoing embodiment, the disclosure is also applicable to an image forming apparatus based on electrophotography.

The configurations and processings described in the foregoing embodiments with reference to FIG. 1 to FIG. 14 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A sheet postprocessing device comprising:

a table that receives a sheet;

a delivery roller that delivers the sheet to the table;

a leading edge cursor provided on the table, and to which a leading edge of the sheet in a delivery direction in which the sheet is delivered, is abutted against;

a stapling device that binds a central position in the delivery direction, of a plurality of the sheets stacked on the table;

a center folding device that folds the sheets, the central position of which has been bound by the stapling device, at the central position; and a first pressing member located on an upper side of the table, and supported so as to pivot in a direction toward and away from the table, about an end portion on an upstream side in the delivery direction serving as a pivotal fulcrum, wherein the first pressing member makes contact with the sheet being delivered to the table, by pivoting toward the table, allows the leading edge of the sheet to pass toward the leading edge cursor, and holds the sheet at a position upstream of the leading edge cursor in the sheet delivery direction, wherein the sheet postprocessing device further comprising a pair of side-edge cursors, provided on the table, at respective sides with respect to the leading edge cursor in a width direction orthogonal to the delivery direction, and configured to receive the sheets delivered to the table, and align positions of respective side edges of the sheets with each other, by contacting the side edges of the sheets in the width direction, wherein the pair of side-edge cursors each include a bottom plate on which the sheet is placed, the bottom plate being oriented parallel to an upper face of the table, a side-edge plate erected along an outer edge of the bottom plate in the width direction, and configured to make contact with the side edge of the sheet, and a second pressing member provided along the side-edge plate on an upper side of the bottom plate, and supported so as to pivot in a direction toward and away from the bottom plate, about an end portion on an upstream side in the delivery direction serving as a pivotal fulcrum, the second pressing member is configured to pivot toward the bottom plate, allow the leading edge of the sheet delivered to the bottom plate to pass, and press the side edge of the sheet received between the pair of side-edge cursors, at a position upstream of the leading edge cursor in the delivery direction, and the pair of side-edge cursors are each located closer to a side edge of the table in the width direction, than is the first pressing member, and a first pressing position where the first pressing member presses the sheet, and a second pressing position where the second pressing member presses the sheet are shifted from each other, in the delivery direction.

2. The sheet postprocessing device according to claim 1, wherein the pair of side-edge cursors each include a top plate provided along an upper edge of the side-edge plate, so as to oppose the bottom plate with a clearance therebetween, and the delivered sheet is received between the bottom plate and the top plate.

3. The sheet postprocessing device according to claim 1, wherein the pair of side-edge cursors are each configured to be moved on the table in the width direction, between a receiving position for receiving the sheet delivered to the table, and an aligning position for aligning the positions of the respective side edges of the sheets with each other, using the side-edge plate, the second pressing member includes an inner protrusion, protruding toward the first pressing member in the width direction, from an end portion of the second pressing member on a side of the first pressing member, and when the pair of side-edge cursors are further moved to a predetermined regulating position close to the first pressing member in the width direction, the inner protrusion makes contact with an upper face of the end portion of the first pressing member.

4. The sheet postprocessing device according to claim 3, wherein the second pressing member includes an outer protrusion protruding toward the side edge of the table in the width direction, and the outer protrusion delimits pivotal motion of the second pressing member, by making contact with the side-edge plate of the side-edge cursor from above.

5. An image forming system comprising:

an image forming apparatus that forms an image of a source document on a sheet; and the sheet postprocessing device according to claim 1, configured to receive the sheet from the image forming apparatus, and perform postprocessing.

6. The image forming system according to claim 5, wherein the image forming apparatus forms the image of the source document on the sheet with ink, by an ink jet printing method.

* * * * *